US006153053A

United States Patent [19]

Harper et al.

[11] Patent Number: 6,153,053

[45] Date of Patent: Nov. 28, 2000

[54] SOFT, BULKY SINGLE-PLY ABSORBENT PAPER HAVING A SERPENTINE CONFIGURATION AND METHODS FOR ITS MANUFACTURE

[75] Inventors: Frank David Harper, Neenah; Taiye Philips Oriaran; John Dennis Litvay, both of Appleton, all of Wis.

[73] Assignee: Fort James Corporation, Deerfield, Ill.

[21] Appl. No.: 09/060,693

[22] Filed: Apr. 15, 1998

[51] Int. Cl.[7] ..... D21H 15/00

[52] U.S. Cl. ..... 162/109; 162/111; 162/112; 162/117; 162/141; 162/149; 162/158; 162/164.3; 162/164.6; 162/165; 162/175; 162/179; 162/183; 428/153

[58] Field of Search ..... 162/109, 111, 162/112, 117, 116, 113, 123, 126, 129, 130, 149, 141, 158, 164.3, 164.6, 165, 168.2, 179, 183–185, 175; 442/97; 428/152–154, 903

[56] References Cited

U.S. PATENT DOCUMENTS

| | | | |
|---|---|---|---|
| 5,147,505 | 9/1992 | Altman | 162/129 |
| 5,405,499 | 4/1995 | Vinson | 162/100 |
| 5,409,572 | 4/1995 | Kershaw et al. | 162/109 |
| 5,582,685 | 12/1996 | Vinson | 162/55 |
| 5,620,565 | 4/1997 | Lazorisak et al. | 162/72 |
| 5,695,607 | 12/1997 | Oriaran et al. | 162/112 |
| 5,851,629 | 12/1998 | Oriaran et al. | 428/153 |
| 5,882,479 | 3/1999 | Oriaran et al. | 162/112 |
| 6,024,834 | 2/2000 | Horton, Jr. et al. | 162/55 |

FOREIGN PATENT DOCUMENTS 0 851 061 7/1998 European Pat. Off. .

*Primary Examiner*—Stanley S. Silverman
*Assistant Examiner*—José S. Fortuna

[57] ABSTRACT

The present invention relates to a soft, thick, single-ply, absorbent paper in the form of a bathroom tissue, facial tissue, or napkin wherein the cellulosic fibers incorporated in the furnish comprise: (a) at least 20 percent by weight of the fibers in the web have a coarseness exceeding 23 mg/100 m; (b) at least about 20 percent by weight of the fibers in the web have a coarseness of less than about 1.2 mg/100 m; and (c) the weight average coarseness to length ratio of the fibers in the web is less than about 8.5 mg/100 m/mm having a serpentine configuration and to a process for the manufacture of such absorbent paper having a basis weight of about 15 lbs. per 3000 square foot ream and having low sidedness, said tissue exhibiting:

a specific total tensile strength of between 40 and 200 grams per 3 inches per pound per 3000 square foot ream, a cross direction specific wet tensile strength of between 2.75 and 20.0 grams per 3 inches per pound per 3000 square foot ream, the ratio of MD tensile to CD tensile of between 1.25 and 2.75, a specific geometric mean tensile stiffness of between 0.5 and 3.2 grams per inch per percent strain per pound per 3000 square foot ream, a friction deviation of less than 0.250, and a sidedness parameter of less than 0.30.

91 Claims, 13 Drawing Sheets

SOFT, BULKY SINGLE-PLY ABSORBENT PAPER HAVING A SERPENTINE CONFIGURATION AND METHODS FOR ITS MANUFACTURE

BACKGROUND OF THE INVENTION

Through air drying has become the technology of preference for making one-ply absorbent paper for many manufacturers who build new absorbent paper machines as, on balance, through air drying ("TAD") offers many economic benefits as compared to the older technique of conventional wet-pressing ("CWP"). With through air drying, it is possible to produce a single-ply absorbent paper in the form of a tissue with good initial softness and bulk as it leaves the absorbent paper machine.

In the older wet pressing method, to produce a premium quality, absorbent paper, it has normally been preferred to combine two plies by embossing them together. In this way, the rougher air-side surfaces of each ply may be joined to each other and thereby concealed within the sheet. However, producing two-ply products, even on state of the art CWP machines, lowers paper machine productivity by about 20% as compared to a one-ply product. In addition, there may be a substantial cost penalty involved in the production of two-ply products because the parent rolls of each ply are not always of the same length, and a break in either of the single plies forces the operation to be shut down until it can be remedied. Also, it is not normally economic to convert older CWP tissue machines to TAD. But even though through air drying has often been preferred for new machines, conventional wet pressing is not without its advantages as well. Water may normally be removed from a cellulosic web at lower energy cost by mechanical means such as by overall compaction than by drying using hot air.

What has been needed in the art is a method of making a premium quality single-ply absorbent paper using conventional wet pressing having a high bulk and excellent softness attributes. In this way advantages of each technology could be combined so older CWP machines can be used to produce high quality single ply absorbent paper products in the form of bathroom tissue and facial tissue at a cost which is far lower than that associated with producing two-ply absorbent paper.

Among the more significant barriers to the production of single-ply CWP absorbent paper have been the thinness and the extreme sidedness of single-ply webs. An absorbent product's softness can be increased by lowering its strength, as it is known that softness and strength are inversely related. However, a product having very low strength will present difficulties in manufacturing and will be rejected by consumers as it will not hold up in use. Use of premium, low coarseness fibers, such as eucalyptus, and stratification of the furnish so that the premium softness fibers are on the outer layers of the tissue is another way of addressing the low softness of CWP products; however this solution is expensive to apply, both in terms of equipment and ongoing fiber costs. In any case, neither of these schemes addresses the problem of thinness of the web. TAD processes employing fiber stratification can produce a nice, soft, bulky sheet having adequate strength and good similarity of the surface texture on the front of the sheet as compared to the back.

Having the same texture on front and back is considered to be quite desirable in these products or, more precisely, having differing texture is generally considered quite undesirable. Because of the deficiencies mentioned above, many single-ply CWP products currently found in the marketplace are typically low end products. These products often are considered deficient in thickness, softness, and exhibit excessive two sidedness. Accordingly, these products have had rather low consumer acceptance and are typically used in "away from home" applications in which the person buying the tissue is not the user.

We have found that we can produce a soft, high basis weight, high bulk, high strength CWP bathroom tissue, facial tissue, and napkins with low sidedness having a serpentine configuration by judicious combination of several techniques as described herein. Basically, these techniques fall into four categories: (a) providing a furnish to a web such that at least 20 percent by weight of the fibers in the web have a coarseness exceeding 23 mg/100 m; (b) at least about 20 percent by weight of the fibers in the web have a coarseness of less than about 12 mg/100 m; (c) the weight average coarseness to length ratio of the fibers in the web is less than about 8.5 mg/100 m/mm; and (d) optionally, the weight-weighted average fiber length is selected to be greater than about 1.75 mm. In addition, optionally, a controlled amount of temporary wet strength may be added along with a softener or debonder. By various combinations of these techniques as described, taught, and exemplified herein, it is possible to almost "dial in" for the absorbent paper the required degree of softness, bulk, and strength depending upon the desired goals. The use of softeners having a melting range of about 1°–40° C. and being dispensable at a temperature of about 1°–100° C. suitably 1°–40° C. preferably 20°–25° C. further improves the properties of the one-ply, high bulk, soft, absorbent paper product having a serpentine configuration.

1. Field of the Invention

The present invention is directed to a soft, strong in use, bulky single-ply absorbent paper product having a serpentine configuration and processes for the manufacture of such paper. More particularly, this invention is directed to a soft, strong-in-use, bulky, single-ply bathroom tissue, facial tissue, and napkin.

2. Description of Background Art

Paper is generally manufactured by suspending cellulosic fiber of appropriate geometric dimensions in an aqueous medium and then removing most of the liquid. The paper derives some of its structural integrity from the mechanical arrangement of the cellulosic fibers in the web, but most by far of the paper's strength is derived from hydrogen bonding which links the cellulosic fibers to one another. With paper intended for use as bathroom tissue, the degree of strength imparted by this inter-fiber bonding, while necessary to the utility of the product, can result in a lack of perceived softness that is inimical to consumer acceptance. One common method of increasing the perceived softness of bathroom tissue is to crepe the paper. Creping is generally effected by fixing the cellulosic web to a Yankee drum thermal drying means with an adhesive/release agent combination and then scraping the web off the Yankee by means of a creping blade. Creping, by breaking a significant number of inter-fiber bonds adds to and increases the perceived softness of resulting tissue product.

Another method of increasing a web's softness is through the addition of chemical softening and debonding agents. Compounds such as quaternary amines that function as debonding agents are often incorporated into the paper web. These cationic quaternary amines can be added to the initial fibrous slurry from which the paper web is subsequently made. Alternatively, the chemical debonding agent may be sprayed onto the cellulosic web after it is formed but before it is dried.

The most pertinent prior art patents will be discussed but, in our view, none of them can be fairly said to apply to the one-ply, absorbent paper of this invention which exhibits high bulk, soft and strong attributes. U.S. Pat. Nos. 5,405,499; 5,585,685; and 5,679,218 are irrelevant to our invention since, by the processes disclosed in those applications, the high coarseness fibers necessary to practice our invention are excluded.

Other prior references include Williams, U.S. Pat. No. 4,247,362, which is related to non delignified softwood and specially treated defibered hardwood; the majority of fibers in the sheet are softwood; Cochrane, et al., U.S. Pat. No. 4,874,465 discloses a sliced (lengthwise) fiber; Reeves, et al., U.S. Pat. No. 5,320,710 discloses hesperaloe fiber; Back, et al., U.S. Pat. No. 5,582,681 discloses newsprint printed with oil-containing ink wherein the pulp is treated with enzymes. All of these patents require the use of unique specialized fiber or a non-conventional stock preparation method, in contrast to the current invention which utilizes conventional paper making fibers prepared by standard pulping and stock preparation methods. Representative layered or stratified paper products in contrast to the present invention which comprises a single (homogenous) layer include Dunning et al, U.S. Pat. No. 4,166,001; Carstens, U.S. Pat. No. 4,300,981; Awofeso, et al., U.S. Pat. No. 5,087,324; and Awofeso, et al., U.S. Pat. No. 5,164,045. From the foregoing discussion of the prior art, it is clear that none of the references relate to one-ply, absorbent papers produced by (a) providing a furnish to a web such that at least 20 percent by weight of the fibers in the web have a coarseness exceeding 23 mg/100 m; (b) at least about 20 percent by weight of the fibers in the web have a coarseness of less than about 12 mg/100 m; (c) the weight average coarseness to length ratio of the fibers in the web is less than about 8.5 mg/100 m/mm; and (d) optionally, the weight-weighted average fiber length is selected to be greater than about 1.75 mm.

In addition, the foregoing prior art references do not disclose or suggest a high-softness, bulky, strong one-ply absorbent paper product in the form of a bathroom tissue and facial tissue having serpentine configuration and having a total specific tensile strength of no more than 200 grams per three inches per pound per 3000 square foot ream, a cross direction wet tensile strength of at least 2.75 grams per three inches per pound per 3000 square foot ream, a specific geometric mean tensile stiffness of 0.5 to 3.2 grams per inch per percent strain per pound per 3,000 square foot ream, a GM friction deviation of no more than 0.25 which are produced when, optionally, temporary wet strength agents and softeners/debonders are added to the web or furnish after the fiber selection has been made wherein (a) at least 20 percent by weight of the fibers in the web have a coarseness exceeding 23 mg/100 m; (b) at least about 20 percent by weight of the fibers in the web have a coarseness of less than about 12 mg/100 m; (c) the weight average coarseness to length ratio of the fibers in the web is less than about 8.5 mg/100 m/mm; and (d) optionally, the weight-weighted average fiber length is greater than about 1.75 mm.

SUMMARY OF THE INVENTION

The novel premium quality high-softness, bulky, single-ply absorbent paper product having a serpentine configuration is advantageously obtained by using a combination of five processing steps.

We have found that we can produce a soft, high basis weight, high bulk, high strength CWP bathroom tissue, facial tissue, and napkins with low sidedness having a serpentine configuration by judicious combination of several techniques as described herein. Basically, these techniques fall into four categories: (a) providing furnish to a web such that at least 20 percent by weight of the fibers in the web have a coarseness exceeding 23 mg/100 m; (b) at least about 20 percent by weight of the fibers in the web have a coarseness of less than about 12 mg/100 m; (c) the weight average coarseness to length ratio of the fibers in the web is less than about 8.5 mg/100 m/mm; and (d) optionally, the weight-weighted average fiber length is selected to be greater than about 1.75 mm. In addition, optionally, a controlled amount of temporary wet strength agent may be added along with a softener/debonder. By various combinations of these techniques as described, taught, and exemplified herein, it is possible to almost "dial in" for the absorbent paper the required degree of softness, bulk, and strength depending upon the desired goals. The use of softeners having a melting range of about 1°–40° C. and being dispensable at a temperature of about 1°–100° C., suitably 1°–40° C., preferably 20°–25° C., further improves the properties of the one-ply, high bulk, soft, absorbent paper product having a serpentine configuration.

One-ply CWP absorbent paper products such as bathroom tissue and facial tissue are formed from a furnish that includes high bulk fibers such as Southern pine or Douglas fir and low coarseness fibers such as Northern hardwoods and eucalyptus. Prior art has recommended that, for maximum softness, low coarseness Northern softwoods such as spruce or fir be used in the furnish. However, one-ply CWP tissues made ply from low-coarseness hardwoods and softwoods exclusively can have low thickness. We have discovered that blends of high bulk and low coarseness fibers had good softness and thickness attributes. In our process the high bulk fibers are included in sufficient quantity to result in good internal sheet delamination at the crepe blade. This delamination has a significant impact in producing a bathroom tissue or a facial tissue with good perceived thickness. Suitably, the fibers are blended in proportions such that the fiber coarseness/fiber length ratio of the blended fibers is controlled to a relatively low value. Our one-ply, absorbent paper products are suitably manufactured as a homogenous structure. Specifically, the furnish comprises (a) at least 20 percent by weight of the fibers in the web having a coarseness exceeding 23 mg/100 m; (b) at least about 20 percent by weight of the fibers in the web having a coarseness of less than about 12 mg/100 m; (c) the weight average coarseness to length ratio of the fibers in the web is less than about 8.5 mg/100 m/mm; and (d) optionally, the weight-weighted average fiber length is selected to be greater than about 1.75 mm. In addition, optionally, a controlled amount of temporary wet strength agent may be added along with a softener/debonder.

Further advantages of the invention will be set forth in part in the description which follows. The advantages of the invention may be realized and attained by means of the instrumentalities and combinations particularly pointed out in the appended claims.

To achieve the foregoing advantages and in accordance with the purpose of the invention as embodied and broadly described herein, there is disclosed:

A method of making a high-softness, high strength, high bulk, single-ply absorbent paper product having a serpentine configuration. This paper product is suitably used in the form of a bathroom tissue or facial tissue. The absorbent paper product is prepared by:

(a) providing a fibrous pulp of papermaking fibers wherein the cellulosic fibers incorporated in the furnish for the web such that: (i) at least 20 percent by weight of the fibers in the web have a coarseness exceeding 23 mg/100 m, (ii) at least about 20 percent by weight of the fibers in the web have a coarseness of less than about 12 mg/100 m, (iii) the weight average coarseness to length ratio of the fibers in the web is less than about 8.5 mg/100 m/mm, and (iv) optionally, the weight-weighted average fiber length is selected to be greater than about 1.75 mm;

(b) forming a nascent web from said pulp, wherein said web has a basis weight of at least about 12.5 lbs./3000 sq. ft. ream;

(c) optionally including in said web at least about 3 lbs./ton of a temporary wet strength agent and up to 10 lbs./ton of a nitrogen containing softener; optionally a cationic nitrogen containing softener; dispersible in water at a temperature of about 1°–100° C. suitably 1°–40° C. advantageously 20°–25° C., advantageously the softener has a melting point below 40° C.;

(d) dewatering said web;

(e) adhering said web to a Yankee dryer;

(f) creping said web from said Yankee dryer optionally using a creping angle of less than 85 degrees, wherein the relative speeds between said Yankee dryer and the take-up reel is controlled to produce a final product MD stretch of at least about 15%;

(g) optionally calendering said web;

(h) optionally embossing said web; and (i) forming a single-ply web wherein steps (a)–(f) and optionally steps (g) and (h) are controlled to result in a single-ply absorbent paper product in the form of a bathroom tissue or facial tissue having a serpentine configuration, high bulk, and a total specific tensile strength of no more than 200 grams per three inches per pound per 3,000 square foot ream, suitably no more than 150 grams per three inches per pound per 3,000 square foot ream, preferably no more than 75 grams per three inches per pound per 3,000 square foot ream, a cross direction wet tensile strength of at least 2.7 grams per three inches per pound per ream, a specific geometric ream tensile stiffness of between 0.5 and 3.2 grams per inch per percent strain per pound per 3,000 square foot ream, a GM friction deviation of no more than 0.25.

To summarize, at a total specific tensile strength of about 200 grams per 3 inches per pound per 3,000 square foot ream or less, the cross direction specific wet tensile strength is about 20 grams per pound per 3,000 square foot ream or higher, the ratio of MD tensile to CD tensile is between 1.25 and 2.75. The specific geometric mean tensile stiffness is 3.2 or less grams per inch per percent strain per pound per 3000 square foot ream. The friction deviation is less than 0.25. At a total specific tensile strength of about 150 grams per pound per 3 inches or less per 3000 square foot ream the cross direction specific wet tensile strength is about 15 grams or less per pound per 3000 square foot ream, the ratio of MD tensile to CD tensile is between 1.25 and 2.75. The specific geometric ream tensile stiffness is 2.4 or less grams per inch per percent strain per pound per 3000 square foot ream and the friction deviation is less than 0.25. When the bathroom tissue or facial tissue product exhibits a total specific tensile strength between 40 and 75 grams per 3 inches per pound per 3000 square foot ream, it has a cross direction specific wet tensile strength of between 2.75 and 7.5 grams per 3 inches per pound per 3000 square foot ream, and its specific geometric mean tensile stiffness is between 0.5 and 1.2 grams per inch per percent strain per pound per 3000 square foot ream and its friction deviation is less than 0.225.

In one embodiment of this invention, the one-ply, absorbent paper product may be embossed with a pattern that includes a first set of bosses which resemble stitches, hereinafter referred to as stitch-shaped bosses, and at least one second set of bosses which are referred to as signature bosses. Signature bosses may be made up of any emboss design and are often a design which is related by consumer perception to the particular manufacturer of the tissue.

In another aspect of the present invention, a paper product is embossed with a wavy lattice structure which forms polygonal cells. These polygonal cells may be diamonds, hexagons, octagons, or other readily recognizable shapes. In one preferred embodiment of the present invention, each cell is filled with a signature boss pattern. More preferably, the cells are alternatively filled with at least two different signature emboss patterns.

In another preferred embodiment, one of the signature emboss patterns is made up of concentrically arranged elements. These elements can include like elements for example, a large circle around a smaller circle, or differing elements, for example a larger circle around a smaller heart. In a most preferred embodiment of the present invention, at least one of the signature emboss patterns are concentrically arranged hearts as can be seen in FIG. 3. Again, in a most preferred embodiment, another signature emboss element is a flower.

The one-ply absorbent paper of this invention in the form of a bathroom tissue or facial tissue has higher softness, bulk, and strength parameters than prior art one-ply absorbent paper products and the embossed one-ply bathroom tissue product and the facial tissue product of the present invention has superior attributes than prior art one-ply embossed tissue products. The use of concentrically arranged emboss elements in one of the signature emboss patterns adds to the puffiness effects realized in the appearance of the paper product tissue. The puffiness associated with this arrangement is the result not only of appearance but also of an actual raising of the tissue upward aided by the bulky cellulosic fibers.

In another embodiment of the present invention, the tissue is embossed between two hard rolls each of which contain both micro male and female elements although some signature or macro elements can be present. The micro male elements of one emboss roll are engaged or mated with the female elements of another mirror image emboss roll as can be seen in FIG. 7. These emboss rolls can be made of materials such as steel or very hard rubber. In this process, the base sheet is only compressed between the sidewalls of the male and female elements. Therefore, base sheet thickness is preserved and bulk perception of a one-ply product is much improved. Also, the density and texture of the pattern improves bulk perception. This mated process and pattern also creates a softer tissue because the top of the tissue protrusions remain soft and uncompressed.

The male elements of the emboss pattern are non-discrete, that is, they are not completely surrounded by flat land area. There are approximately an equal number of male and female elements on each emboss roll. This increases the perceived bulk of the product and makes both sides of the emboss tissue symmetrical and equally pleasing to the touch.

Another advantage of the mated embossed embodiment of the present invention is the type of textured surface that is created. This texture provides for better cleansing of the skin than a typically embossed CWP one-ply tissue which is very smooth in the unembossed areas. The surface of the CWP product of the present invention is better than that of a typical through-air-dried (TAD) product in that it has texture but more uniformly bonded fibers. Therefore, the fibers on the surface of the tissue do not pill or ball up, especially when the tissue becomes wet. In contrast, there are significant portions of the typical textured TAD tissue surface where fibers are weakly bonded. These fibers tend to pill when the tissue becomes wet, even when a significant amount of wet strength has been added to the fibers.

A preferred emboss pattern for the present invention is shown in FIGS. 4A-1, 4A-2, 4A-3 and 4B. It contains diamond shaped male, female and mid-plane elements which all have a preferred width of 0.023 inches. The width is preferably between about 0.005 inches and about 0.070 inches, more preferably between about 0.015 inches and about 0.045 inches, most preferably between about 0.025 inches and about 0.035 inches. The shape of the elements can be selected as circles, squares or other easily understood shapes. When a micro and macro pattern are used, the distance between the end of the macroelements and the start of the microelements is preferably between about 0.007 inches and about 1 inch, more preferably between about 0.005 and about 0.045, and most preferably between about 0.010 and about 0.035. The height of the male elements above the mid-plane is preferably about 0.0155 inches and the depth of the female elements is preferably about 0.0155 inches. The angle of the sidewalls of the elements is preferably between about 10 and about 30 degrees, more preferably between about 18 and about 23 degrees, most preferably about 21 degrees. In a most preferred embodiment, the elements are about 50% male and about 50% female.

Patterns such as those shown in FIGS. 4A-1, 4A-2, 4A-3 and 4B can be combined with one or more signature emboss pattern to create products of the present invention. Signature bosses are made up of any emboss design and are often a design which is related by consumer perception to the particular manufacturer of the tissue.

More preferred emboss patterns for the present invention are shown in FIGS. 5A-1, 5A-2, 5A-3, 5B-1, 5B-2 and 5B-3. These patterns are exact mirror images of one another. These emboss patterns combine the diamond micro pattern in FIGS. 4A-1, 4A-2, 4A-3 and 4B with a large, signature or "macro" pattern. This combination pattern provides aesthetic appeal from the macro pattern as well as the improvement in perceived bulk and texture created by the micro pattern. The macro portion of the pattern is mated so that it does not reduce softness by increasing the friction on the back side of the sheet. In addition to providing improved aesthetics, this pattern minimizes nesting (the complete overlap of embossing elements) and improves roll structure by increasing the repeat length for the pattern from 0.0925 inches to 5.0892 inches.

The design of the macroelements in the more preferred emboss pattern preserves strength of the tissue. This is done by starting the base of the male macroelements at the mid-plane of the microelements as shown in FIGS. 5B-1, 5B-2 and 5B-3. The female macroelements are started at the mid-plane of the microelements as shown in FIGS. 5A-1, 5A-2 and 5A-3 . This reduces the stretching of the sheet from the mid-plane by 50%. However, because the macroelements are still 31 mils in height in depth, they still provide a crisp, clearly defined pattern.

The more preferred emboss pattern has the bases of male microelements and the opening of female microelements kept at least 0.014 inches away from the base of male macroelements or openings of female macroelements. This prevents the emboss rolls from plugging with tissue.

It is also possible to put some of the male macroelements going one direction and the rest of them going the other direction. This may further reduce any sidedness in the product. FIGS. 5*c* and 5*d* show the actual size of the preferred patterns.

BRIEF DESCRIPTION OF THE DRAWINGS

The present invention will become more fully understood from the detailed description given herein below and the accompanying drawings which are given by way of illustration only and thus are not limiting of the present invention.

FIGS. 4A-1, 4A-2, 4A-3 and 4B illustrate micro emboss patterns on the one-ply, absorbent paper of the present invention.

FIGS. 5A-1, 5A-2, 5A-3, 5B-1, 5B-2, 5B-3, 5C and 5D illustrate another emboss pattern on the absorbent paper of the present invention.

DETAILED DESCRIPTION OF THE PREFERRED EMBODIMENTS

One-ply CWP absorbent paper products such as bathroom tissue and facial tissue are formed from high bulk fibers such as Southern pine or Douglas fir and low coarseness fibers such as Northern hardwoods and eucalyptus. Prior art has recommended that, for maximum softness, low coarseness Northern softwoods such as spruce or fir be used in the furnish. However, CWP bathroom tissue and facial tissue made only from low-coarseness hardwoods and softwoods have low thickness. We have discovered that blends of high-bulk and low-coarseness fibers had good softness and thickness attributes. In our process the high bulk fibers are included in sufficient quantity to result in good internal sheet delamination at the crepe blade. This delamination has a significant impact in producing a bathroom tissue or a facial tissue with good perceived thickness. Suitably, the fibers are blended in proportions such that the fiber coarseness/fiber length ratio of the blended fibers is controlled to a relatively low value. Our one-ply, absorbent paper products are suitably manufactured as a homogenous structure. Specifically the furnish is designed to produce at the web the following conditions: (a) at least 20 percent by weight of the fibers in the web have a coarseness exceeding 23 mg/100 m; (b) at least about 20 percent by weight of the fibers in the web have a coarseness of less than about 12 mg/100 m; (c) the weight average coarseness to length ratio of the fibers in the web is less than about 8.5 mg/100 m/mm; and (d) optionally, the weight-weighted average fiber length is selected to be greater than about 1.75 mm; (e) optionally, the absorbent paper product is embossed. In addition, optionally, a controlled amount of temporary wet strength agent may be added along with a softener/debonder.

Figure 2:
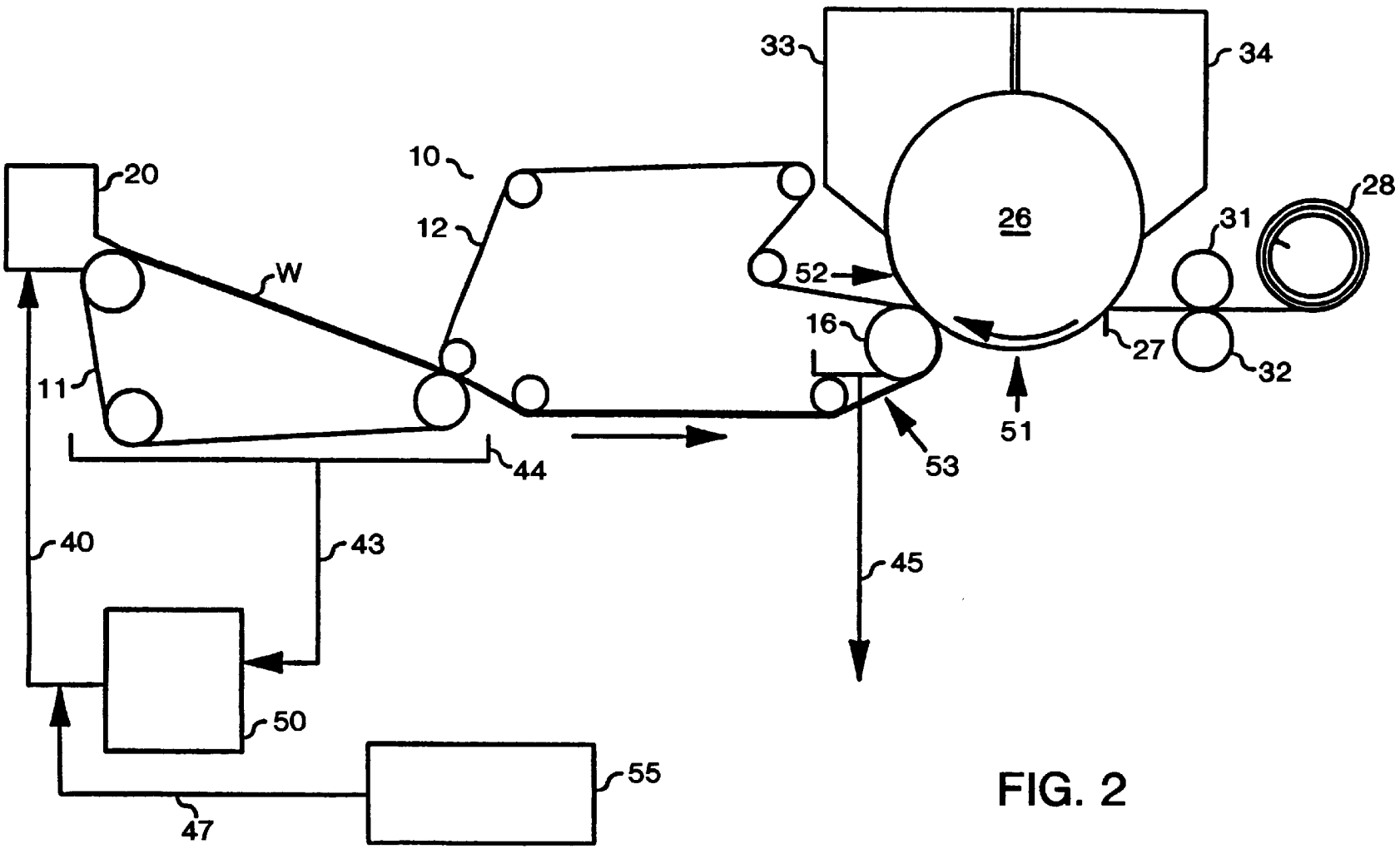
FIG. 2 is a schematic flow diagram of the papermaking process showing suitable points of addition of charge less temporary wet strength chemical moieties and optionally starch and softener/debonder.

FIG. 2 illustrates an embodiment of the present invention wherein machine chest (55) is used for preparing the papermaking furnish. Functional chemicals such as dry strength agents, temporary wet strength agents and softening agents may be added to the furnish in the machine chest (55) or in conduit (47). The furnish may be treated sequentially with chemicals having different functionality depending on the character of the fibers that constitute the furnish, particularly their fiber length and coarseness, and depending on the precise balance of properties desired in the final product. The furnish is diluted to a low consistency, typically 0.5% or less, and transported through conduit (40) to headbox (20) of a paper machine (10). FIG. 2 includes a web-forming end or wet end with a liquid permeable foraminous forming fabric (11) which may be of any conventional configuration.

A wet nascent web (W) is formed in the process by ejecting the dilute furnish from headbox (20) onto forming fabric (11). The web is dewatered by drainage through the forming fabric, and additionally by such devices as drainage foils and vacuum devices (not shown). The water that drains through the forming fabric may be collected in savall (44) and returned to the papermaking process through conduit (43) to silo (50), from where it again mixes with the furnish coming from machine chest (55).

From forming fabric (11), the wet web is transferred to felt (12). Additional de-watering of the wet web may be provided prior to thermal drying, typically by employing a nonthermal dewatering means. This nonthermal dewatering is usually accomplished by various means for imparting mechanical compaction to the web, such as vacuum boxes, slot boxes, contacting press rolls, or combinations thereof. The wet nascent web (W) is carried by the felt (12) to the pressing roll (16) where the wet nascent web (W) is transferred to the drum of a Yankee dryer (26). Fluid is pressed from the wet web (W) by pressing roll (16) as the web is transferred to the drum of the Yankee dryer (26) at a fiber consistency of at least about 5% up to about 50%, preferably at least 15% up to about 45%, and more preferably to a fiber consistency of approximately 40% or greater. The web is then dried by contact with the heated Yankee dryer and by impingement of hot air onto the sheet, said hot air being supplied by hoods (33) and (34). The web is then creped from the dryer by means of a creping blade (27). The finished web may be pressed between calendar rolls (31) and (32) and is then collected on a take-up roll (28).

Adhesion of the partially dewatered web to the Yankee dryer surface is facilitated by the mechanical compressive action exerted thereon, generally using one or more pressing rolls (16) that form a nip in combination with thermal drying means (26). This brings the web into more uniform contact with the thermal drying surface. The attachment of the web to the Yankee dryer may be assisted and the degree of adhesion between the web and the dryer controlled by application of various creping aids that either promote or inhibit adhesion between the web and the dryer (26). These creping aids are usually applied to the surface of the dryer (26) at position (51), prior to its contacting the web.

Also shown in FIG. 2 are the location for applying functional chemicals to the already-formed cellulosic web. According to one embodiment of the process of the invention, the temporary wet strength agent can be applied directly on the Yankee (26) at position (51) prior to application of the web thereto. In another preferred embodiment, the wet strength agent can be applied from position (52) or (53) on the air-side of the web or on the Yankee side of the web respectively. Softeners are suitably sprayed on the air side of the web from position (52) or on the Yankee side from position (53) as shown in FIG. 2. The softener/debonder can also be added to the furnish prior to its introduction to the headbox (20). Again, when a starch based temporary wet strength agent is added, it should be added to the furnish prior to web formation. The softener may be added either before or after the starch has been added, depending on the balance of softness and strength attributes desired in the final product. In general, charged temporary wet strength agents are added to the furnish prior to its being formed into a web, while uncharged temporary wet strength agents are added to the already formed web as shown in FIG. 2.

Papermaking fibers used to form the soft absorbent, single-ply products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention, including non-woody fibers liberated from sugar cane, bagasse, sabai grass, rice straw, banana leaves, paper mulberry (i.e., bast fiber), abaca leaves, pineapple leaves, esparto grass leaves, and fibers from the genus Hesperaloe in the family Agavaceae. Suitable fibers are disclosed in U.S. Pat. Nos. 5,320,710 and 3,620,911, both of which are incorporated herein by reference. However, the cellulosic fiber irrespective of origin have to meet the following parameters: (a) at least 20 percent by weight of the fibers in the web have to have a coarseness exceeding 23 mg/100 m; (b) at least about 20 percent by weight of the fibers in the web have to have a coarseness of less than about 12 mg/100 m; (c) the weight average coarseness to length ratio of the fibers in the web has to be less than about 8.5 mg/100 m/mm; and (d) optionally, the weight-weighted average fiber length of the fibers in the web has to be greater than about 1.75 mm.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, etc. Furthermore, papermaking fibers are liberated from source material by any one of a number of mechanical/chemical pulping processes familiar to anyone experienced in the art including mechanical pulping, thermomechanical pulping, and chemi thermomechanical pulping. These mechanical pulps are bleached, if one wishes, by a number of familiar bleaching schemes including alkaline peroxide and ozone bleaching. A significant advantage of the invention over the prior art processes is that significant amounts of coarse hardwoods and softwoods are utilized to create a bulky, soft product in the process of this invention while prior art one-ply products had to be prepared from more expensive low-coarseness softwoods and low-coarseness hardwoods such as eucalyptus. This invention is also applicable to recycled or secondary fibers which can be mixed with the fibers described above.

For special applications of the premium one-ply absorbent paper product, the paper product of the present invention is optionally be treated with a temporary wet strength agent. It is believed that the inclusion of the temporary wet strength agent facilitates the absorbent paper in the form of a bathroom tissue or facial tissue to hold up in use despite its relatively low dry strength. The bathroom tissues and facial tissues of this invention having a suitable level of temporary wet strength are generally perceived as being stronger and thicker in use than similar products having low wet strength values. Suitable wet strength agents comprise an organic moiety and suitably include water soluble aliphatic dialdehydes or commercially available water soluble organic polymers comprising aldehydic units, and cationic starches containing aldehyde moieties. These agents are suitably used singly or in combination with each other.

Suitable temporary wet strength agents are aliphatic and aromatic aldehydes including glyoxal, malonic dialdehyde, succinic dialdehyde, glutaraldehyde, dialdehyde starches, polymeric reaction products of monomers or polymers having aldehyde groups and optionally nitrogen groups. Representative nitrogen containing polymers which can suitably be reacted with the aldehyde containing monomers or polymers include vinylamide, acrylamides and related nitrogen containing polymers. These polymers impart a positive charge to the aldehyde containing reaction product. In addition, other commercially available temporary wet strength agents such as Parez 745 manufactured by Cytec can be used, along with those disclosed, for example, in U.S. Pat. No. 4,605,702.

We have found that condensates prepared from dialdehydes such as glyoxal or cyclic urea and polyol both containing aldehyde moieties are useful for producing temporary wet strength. Since these condensates do not have a charge, they are added to the web as shown in FIG. 2 before or after the pressing roll (16) or charged directly on the Yankee surface. Suitably these temporary wet strength agents are sprayed on the air side of the web prior to drying on the Yankee as shown in FIG. 2 from position 52.

The preparation of cyclic ureas is disclosed in U.S. Pat. No. 4,625,029 herein incorporated by reference in its entirety. Other U.S. Patents of interest disclosing reaction products of dialdehydes with polyols include U.S. Pat. Nos. 4,656,296; 4,547,580; and 4,537,634 and are also incorporated into this application by reference in their entirety. The dialdehyde moieties expressed in the polyols render the whole polyol useful as a temporary wet strength agent in the manufacture of the one-ply tissue of this invention. Suitable polyols are reaction products of dialdehydes such as glyoxal with polyols having at least a third hydroxyl group. Glycerin, sorbitol, dextrose, glycerin monoacrylate, and glycerin monomaleic acid ester are representative polyols useful as temporary wet strength agents.

Polysaccharide aldehyde derivatives are suitable for use in the manufacture of the tissues of this invention. The polysaccharide aldehydes are disclosed in U.S. Pat. Nos. 4,983,748 and 4,675,394. These patents are incorporated by reference into this application. Suitable polysaccharide aldehydes have the following structure:

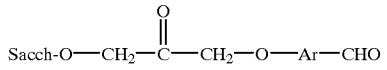

wherein Ar is an aryl group. This cationic starch is a representative cationic moiety suitable for use in the manufacture of the bathroom tissue or the facial tissue of the present invention and can be charged with the furnish. A starch of this type can also be used without other aldehyde moieties but, in general, should be used in combination with a cationic softener.

The tissues of this invention suitably include polymers having non-nucleophilic water soluble nitrogen heterocyclic moieties in addition to aldehyde moieties.

Representative resins of this type are:

A. Temporary wet strength polymers comprising aldehyde groups and having the formula:

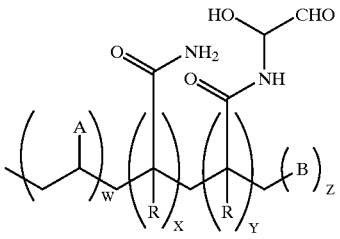

wherein A is a polar, non-nucleophilic unit which does not cause said resin polymer to become water-insoluble; B is a hydrophilic, cationic unit which imparts a positive charge to the resin polymer; each R is H, $C_1$–$C_4$ alkyl or halogen; wherein the mole percent of W is from about 58% to about 95%; the mole percent of X is from about 3% to about 65%; the mole percent of Y is from about 1% to about 20%; and the mole percent from Z is from about 1% to about 10%; said resin polymer having a molecular weight of from about 5,000 to about 200,000.

B. Water soluble cationic temporary wet strength polymers having aldehyde units which have molecular weights of from about 20,000 to about 200,000, and are of the formula:

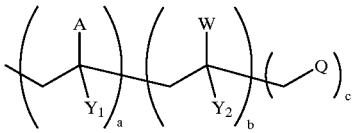

wherein A is

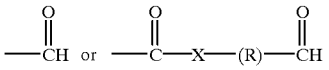

and X is —O—, —NH—, or —$NCH_3$— and R is a substituted or unsubstituted aliphatic group; $Y_1$ and $Y_2$ are independently —H, —$CH_3$, or a halogen, such as C or F; W is a nonnucleophilic, water-soluble nitrogen heterocyclic moiety; and Q is a cationic monomeric unit. The mole percent of "a" ranges from about 30% to about 70%, the mole percent of "b" ranges from about 30% to about 70%, and the mole percent of "c" ranges from about 1% to about 40%.

The temporary wet strength resin may be any one of a variety of water soluble organic polymers comprising aldehydic units and cationic units used to increase the dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769; 5,217,576; also 4,605,702; 5,723,022; and 5,320,711. Among the preferred temporary wet strength resins that are used in practice of the present invention are modified starches sold under the trademarks Co-Bond® 1000 and Co-Bond® 1000 Plus by National Starch and Chemical Company of Bridgewater, N.J. Prior to use, the cationic aldehydic water soluble polymer is prepared by preheating an aqueous slurry of approximately 5% solids maintained at a temperature of approximately 240° Fahrenheit and a pH of about 2.7 for approximately 3.5 minutes. Finally, the slurry is quenched and diluted by adding water to produce a mixture of approximately 1.0% solids at less than about 130° F.

Co-Bond® 1000 is a commercially available temporary wet strength resin including an aldehydic group on cationic corn waxy hybrid starch. The hypothesized structure of the molecules are set forth as follows:

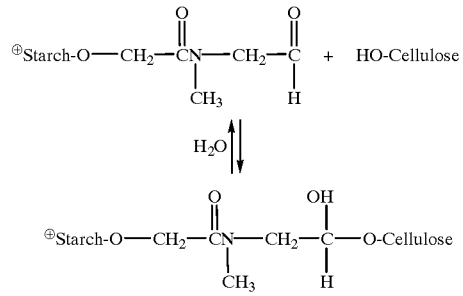

Other preferred temporary wet strength resins, also available from the National Starch and Chemical company are sold under the trademarks Co-Bond® 1600 and Co-Bond® 2500. These starches are supplied as aqueous colloidal dispersions and do not require preheating prior to use.

In addition to the temporary wet strength agent, the one-ply absorbent paper in the form of a bathroom tissue or facial tissue, or napkin also contains one or more softeners. These softeners are suitably nitrogen containing organic compounds preferably cationic nitrogenous softeners and may be selected from trivalent and tetravalent cationic organic nitrogen compounds incorporating long fatty acid chains; compounds including imidazolines, amino acid salts, linear amine amides, tetravalent or quaternary ammonium salts, or mixtures of the foregoing. Other suitable softeners include the amphoteric softeners which may consist of mixtures of such compounds as lecithin, polyethylene glycol (PEG), castor oil, and lanolin. For optimum results the softeners should be dispersible in water at a temperature of about 1° C. to 100° C. suitably 1° C. to 40° C. preferably at ambient temperatures. For maximum perception of softness in the tissue, the softeners should have a melting point below 40° C.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, *Chemistry and Industry*, Jul. 5, 1969, pp. 893–903; Egan, *J. Am. Oil Chemist's Soc.*, Vol. 55 (1978), pp.118–121; and Trivedi et al., *J. Am. Oil Chemist's Soc.*, June 1981, pp. 754–756. All of the above are incorporated herein by reference. As indicated therein, softeners are often available commercially only as complex mixtures rather than as single compounds. While this discussion will focus on the predominant species, it should be understood that commercially available mixtures would generally be used to practice the invention.

The softener having a charge, usually cationic softeners, can be supplied to the furnish prior to web formation, applied directly onto the partially dewatered web or may be applied by both methods in combination. Alternatively, the softener may be applied to the completely dried, creped sheet, either on the paper machine or during the converting process. Softeners having no charge are applied at the dry end of the papermaking process.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active basis, is suitably from about 1.0 pound per ton of furnish up to about 10 pounds per ton of furnish; preferably from about 2 to about 7 pounds per ton of furnish.

Imidazoline-based softeners that are added to the furnish prior to its formation into a web have been found to be particularly effective in producing soft absorbent paper products in the form of bathroom tissue, facial tissue, and napkin products and constitute a preferred embodiment of this invention. Of particular utility for producing the soft absorbent paper products of this invention are the cold-water dispersible imidazolines. These imidazolines are formulated with alkoxylated diols, alkoxylated polyols, diols and polyols to produce softeners which render the usually insoluble imidazoline softeners water dispersible at temperatures of 0°–100° C. suitably at 0°–40° C. and preferably at 20°–25° C. Representative initially water insoluble imidazoline softeners rendered water dispersible by formulation of these with water soluble polyols, diols, alkoxylated polyols and alkoxylated diols include Witco Corporation's Arosurf PA 806 and DPSC 43/13 which are water dispersible versions of tallow and oleic-based imidazolines, respectively.

Treatment of the partially dewatered web with the softener can be accomplished by various means. For instance, the treatment step can comprise spraying, as shown in FIG. 2, applying with a direct contact applicator means, or by employing an applicator felt. It is often preferred to supply the softener to the air side of the web from position 52 shown in FIG. 2, so as to avoid chemical contamination of the paper making process. It has been found in practice that a softener applied to the web from either position 52 or position 53 shown in FIG. 2 penetrates the entire web and uniformly treats it.

Useful softeners for spray application include softeners having the following structure:

$$[(RCO)_2EDA]HX$$

wherein EDA is a diethylenetriamine residue, R is the residue of a fatty acid having from 12 to 22 carbon atoms, and X is an anion or $$[(RCONHCH_2CH_2)_2NR']HX$$

wherein R is the residue of a fatty acid having from 12 to 22 carbon atoms, R' is a lower alkyl group, and X is an anion.

More specifically, preferred softeners for application to the partially dewatered web are Quasoft® 218, 202, and 209-JR made by Quaker Chemical Corporation which contain a mixture of linear amine amides and imidazolines.

Another suitable softener is a dialkyl dimethyl fatty quaternary ammonium compound of the following structure:

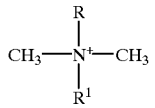

wherein R and $R^1$ are the same or different and are aliphatic hydrocarbons having fourteen to twenty carbon atoms preferably the hydrocarbons are selected from the following: $C_{16}H_{35}$ and $C_{18}H_{37}$.

A new class of softeners having a melting range of about 0–40° C. are particularly effective in producing the soft one-ply tissue of this invention. These softeners comprise imidazoline moieties formulated with organic compounds selected from the group consisting of aliphatic diols, alkoxylated aliphatic diols, aliphatic polyols, alkoxylated aliphatic polyols and/or a mixture of these. Preferably, these softeners are dispersible in water at a temperature of about 1° C. to about 40° C. and have a melting range below 40° C.

The imidazoline moiety is of the formula:

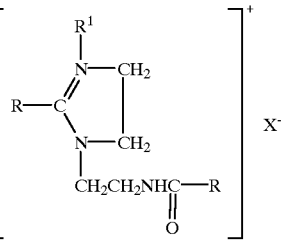

wherein X is an anion and R is selected from the group of saturated and unsaturated paraffinic moieties having a carbon chain length of $C_{12}$ to $C_{20}$ and $R^1$ is selected from the group of saturated paraffinic moieties having a carbon chain length of $C_1$ to $C_3$. Suitably the anion is methyl sulfate or ethyl sulfate or the chloride moiety. The preferred carbon chain length is $C_{12}$to $C_{18}$. The preferred diol is 2,2,4 trimethyl 1,3 pentane diol and the preferred alkoxylated diol is ethoxylated 2,2,4 trimethyl 1,3 pentane diol. In general, these softeners are dispersible in water at a temperature of about 1°–100° C., usually 1°–40° C., preferably 20°–25° C. These softeners have a melting range below 40° C.

The web is dewatered preferably by an overall compaction process. The partially dried web is then preferably adhered to a Yankee dryer. The adhesive is added directly to the metal of the Yankee, and advantageously, it is sprayed directly on the surface of the Yankee dryer drum. Any suitable art recognized adhesive may be used on the Yankee dryer. Suitable adhesives are widely described in the patent literature. A comprehensive but non-exhaustive list includes U.S. Pat. Nos. 5,246,544; 4,304,625; 4,064,213; 4,501,640; 4,528,316; 4,883,564; 4,684,439; 4,886,579; 5,374,334; 5,382,323; 4,094,718; and 5,281,307. Adhesives such as glyoxylated polyacrylamide, and polyaminoamides have been shown to provide high adhesion and are particularly suited for use in the manufacture of the one-ply product. The preparation of the polyaminoamide resins is disclosed in U.S. Pat. No. 3,761,354 which is incorporated herein by reference. The preparation of polyacrylamide adhesives is disclosed in U.S. Pat. No. 4,217,425 which is incorporated herein by reference. Typical release agents can be used in accordance with the present invention; however, the amount of release, should one be used at all, will often be below traditional levels.

The web is then creped from the Yankee dryer and calendered wherein the moisture content is less than ten percent. It is necessary that the product of the present invention have a relatively high machine direction stretch. The final product's machine direction stretch should be at least about 15%, preferably at least about 18%. The relative speeds between the Yankee dryer and the reel are usually controlled such that a reel crepe of at least about 18%, more preferably 20%, and most preferably 23% is maintained, but the reel crepe can also be kept below 18%. The one-ply tissues of this invention have the high bulk and softness favored by the consumer but unavailable on the market from CWP paper making mills using prior art manufacturing and fiber selection methods. Creping is preferably carried out at a creping angle of from about 65 to about 85 degrees, preferably about 70 to about 80 degrees, and more preferably about 75 degrees. The creping angle is defined as the angle formed between the surface of the creping blade's edge and a line tangent to the Yankee dryer at the point at which the creping blade contacts the dryer.

Optionally, to obtain maximum softness of the one-ply bathroom tissue and one-ply facial tissue the web is embossed. The web may be embossed with any art recognized embossing pattern, including, but not limited to, overall emboss patterns, spot emboss patterns, micro emboss patterns, which are patterns made of regularly shaped (usually elongate) elements whose long dimension is 0.050 inches or less, or combinations of overall, spot, and micro emboss patterns.

In one embodiment of the present invention, the emboss pattern of the one-ply product may include a first set of bosses which resemble stitches, hereinafter referred to as stitch-shaped bosses, and at least one second set of bosses which are referred to as signature bosses. Signature bosses may be made up of any emboss design and are often a design which is related by consumer perception to the particular manufacturer of the tissue.

In another aspect of the present invention, a paper product is embossed with a wavy lattice structure which forms polygonal cells. These polygonal cells may be diamonds, hexagons, octagons, or other readily recognizable shapes. In one preferred embodiment of the present invention, each cell is filled with a signature boss pattern. More preferably, the cells are alternatively filled with at least two different signature emboss patterns.

Figure 3:
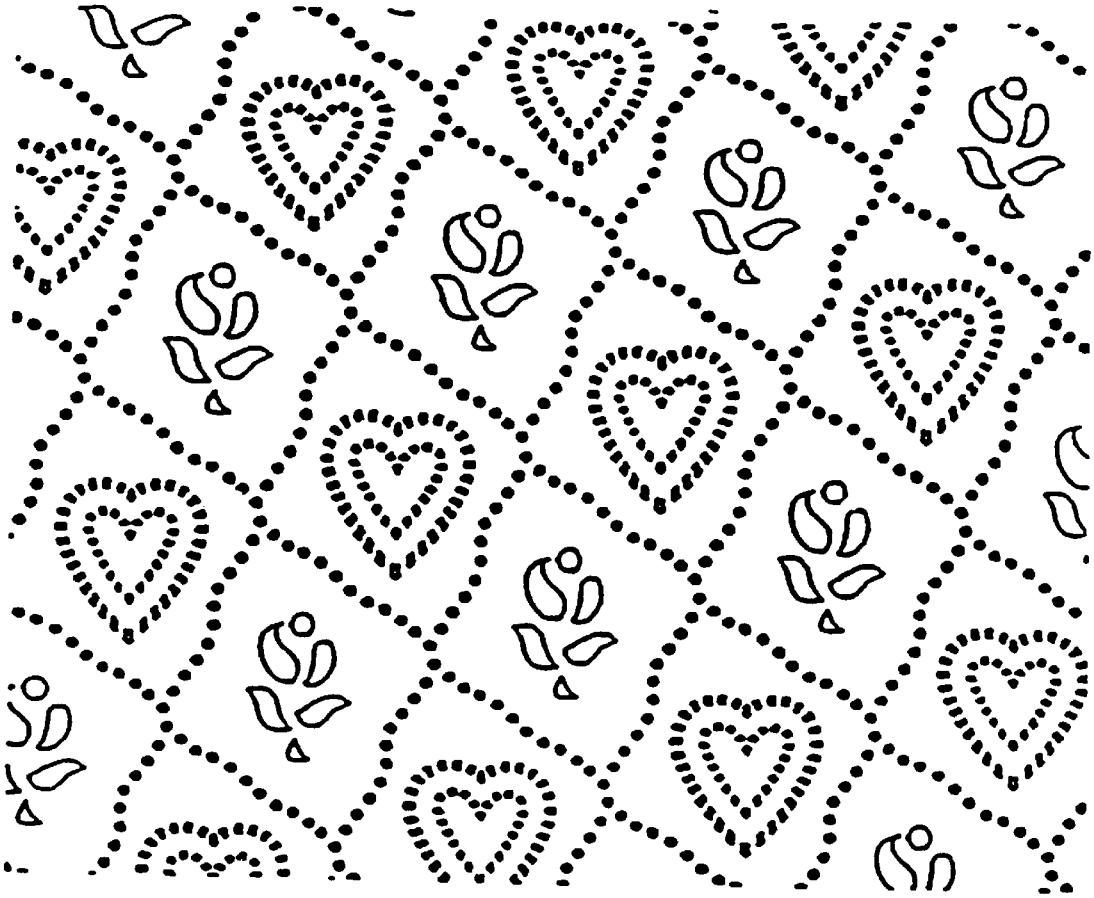
FIG. 3 illustrates the double heart emboss pattern.
Figures 1, 4A:
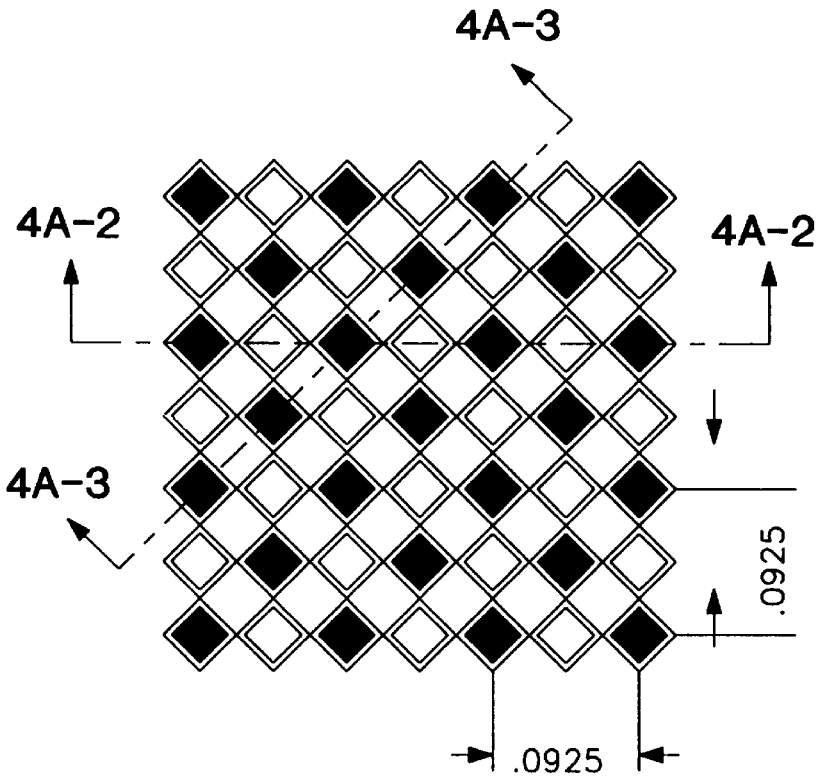
Figures 3, 4A:
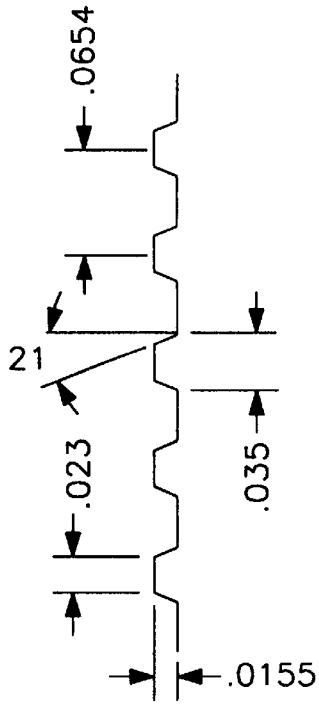
Figures 2, 4A:
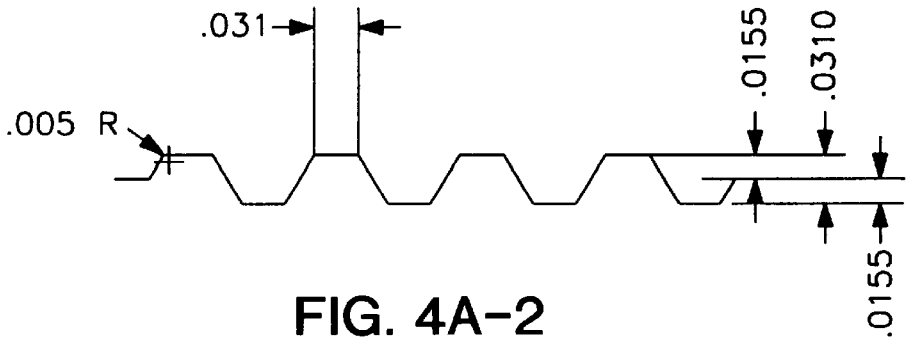
Figure 4B:
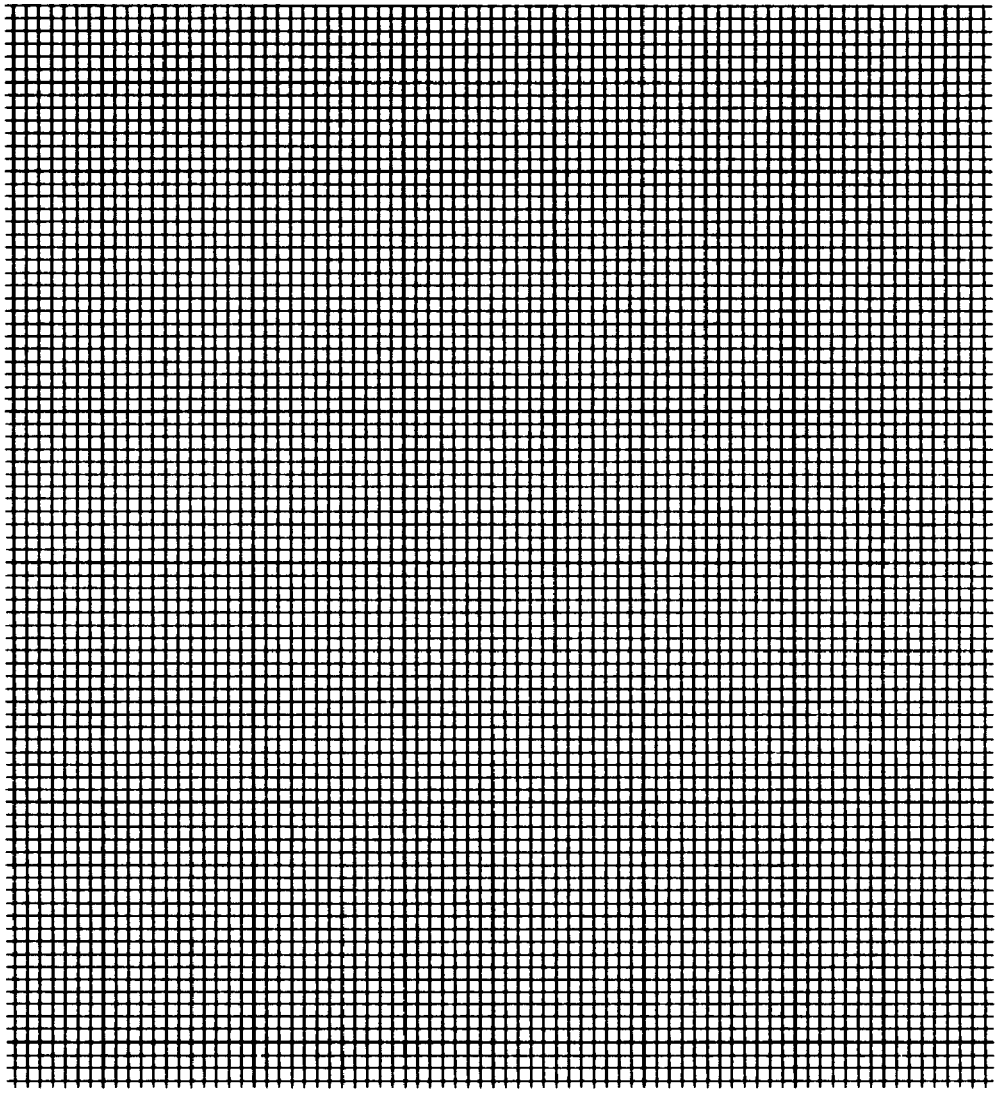
Figures 1, 5A:
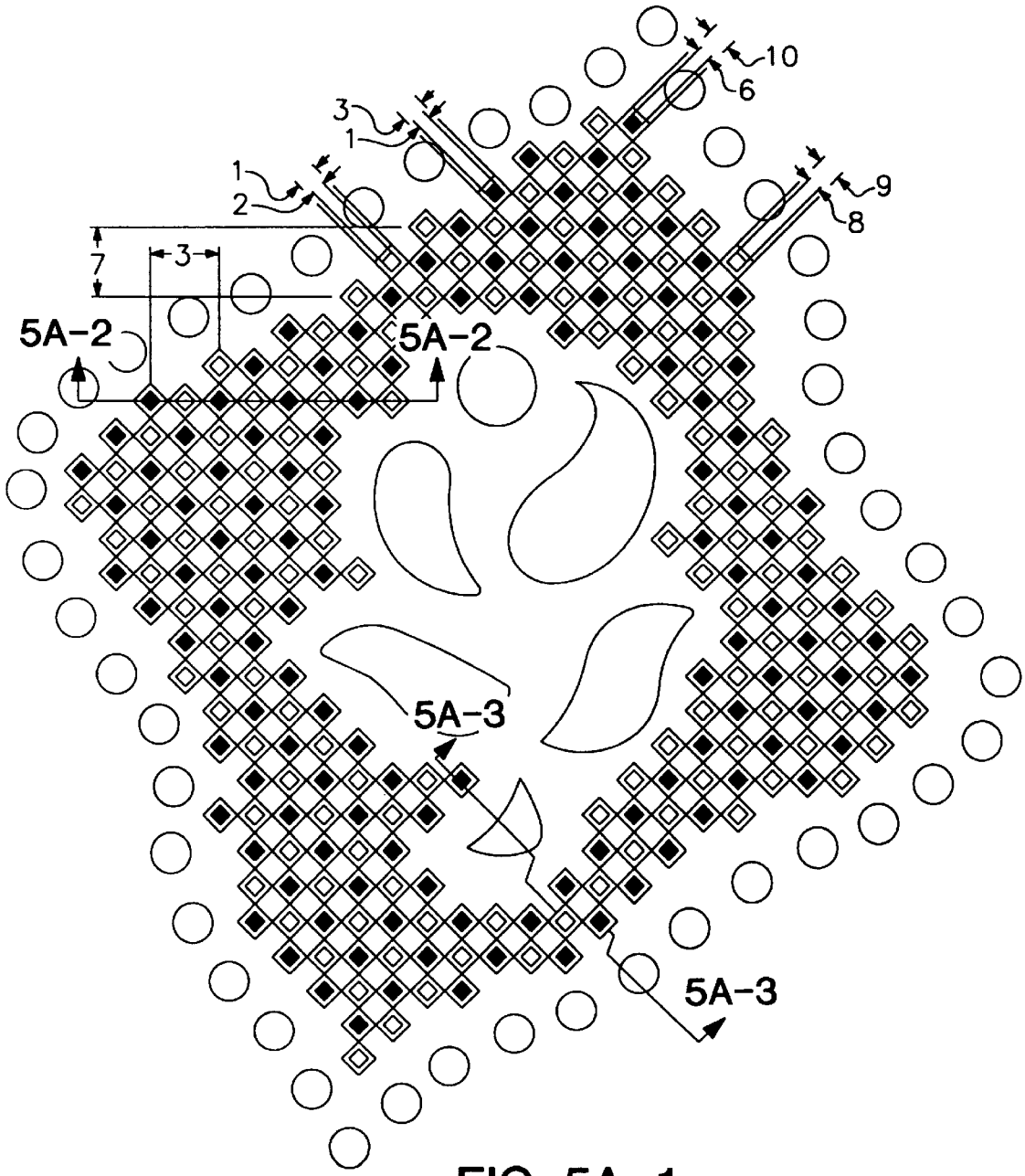
Figures 2, 5A:
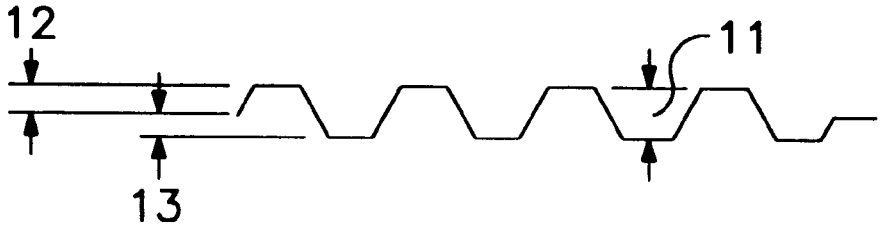
Figures 3, 5A:
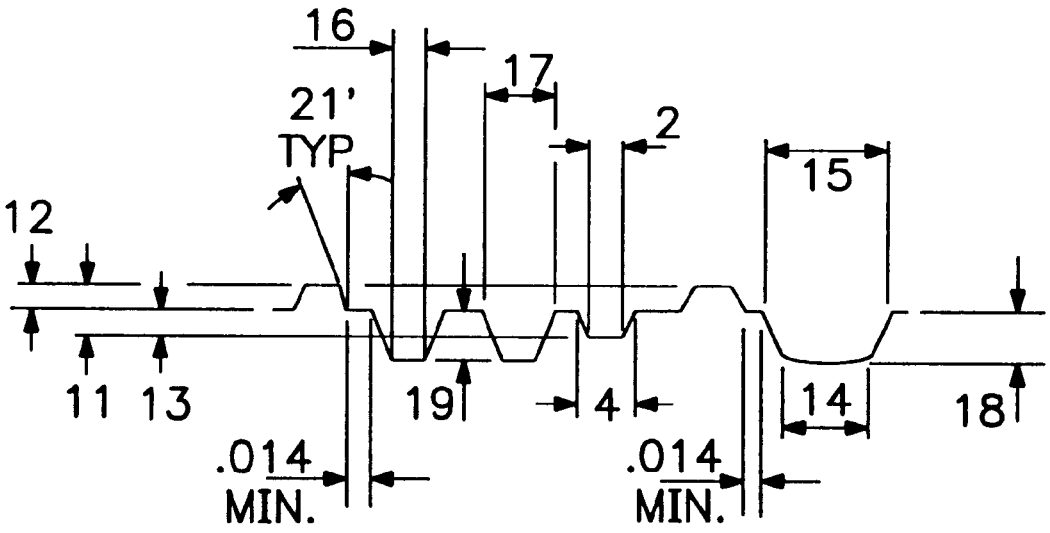
Figures 1, 5B:
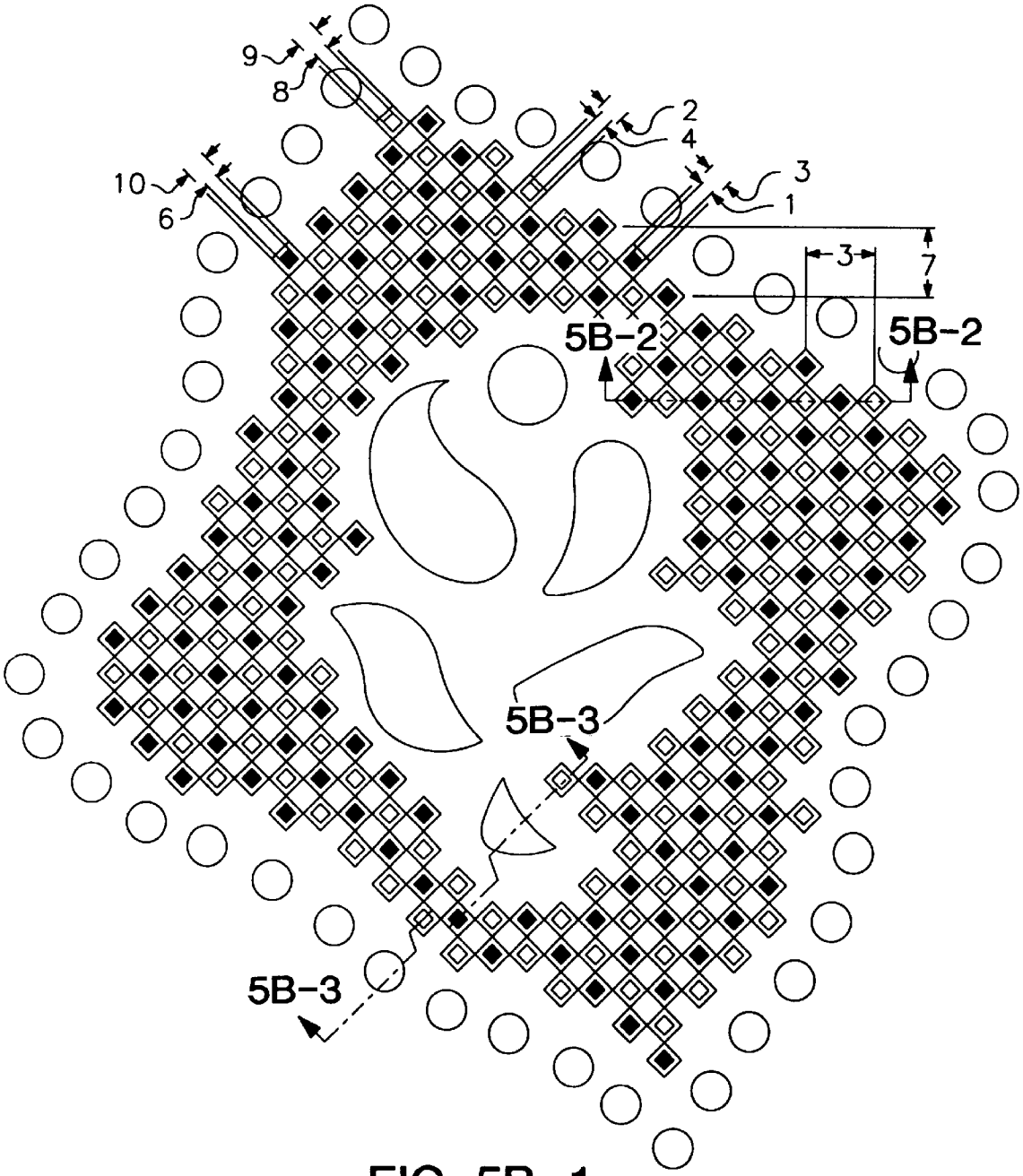
Figures 2, 5B:
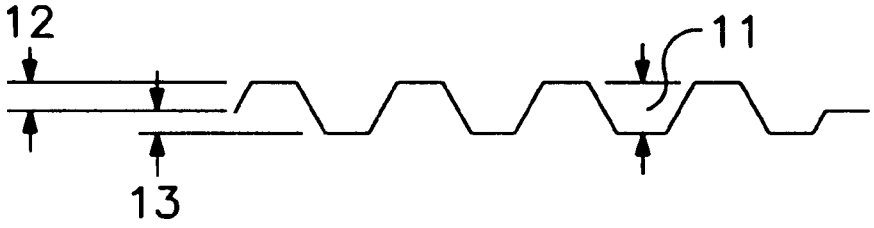
Figures 3, 5B:
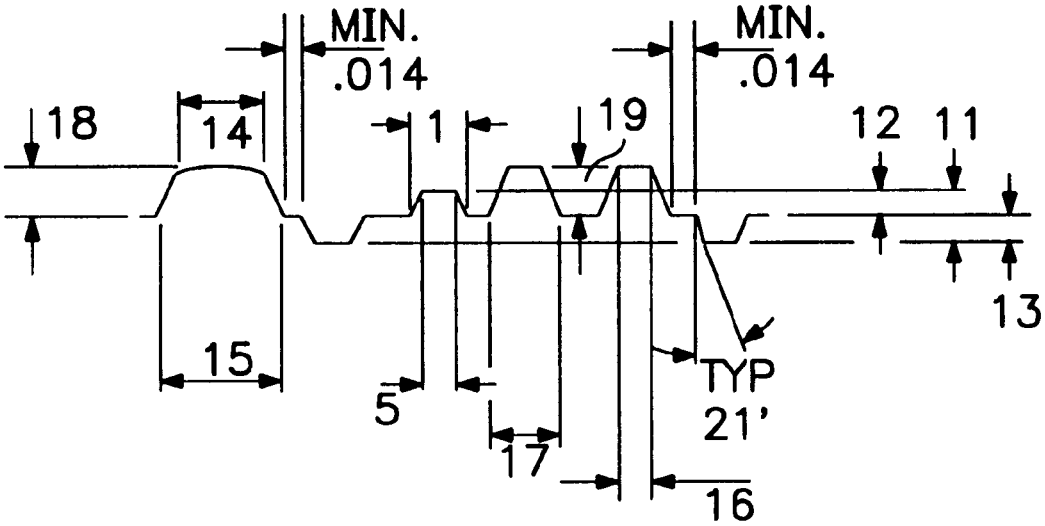
Figure 5C:
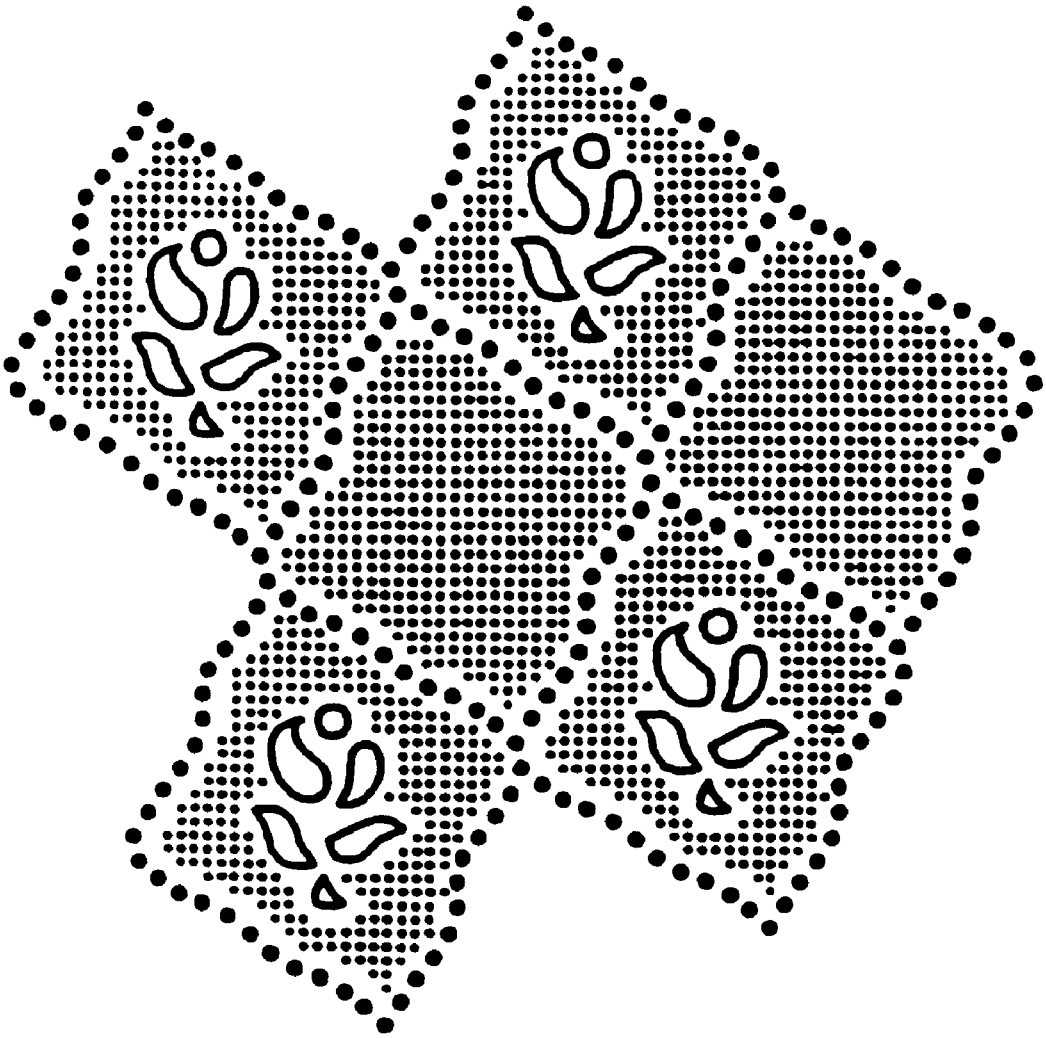
Figure 5D:
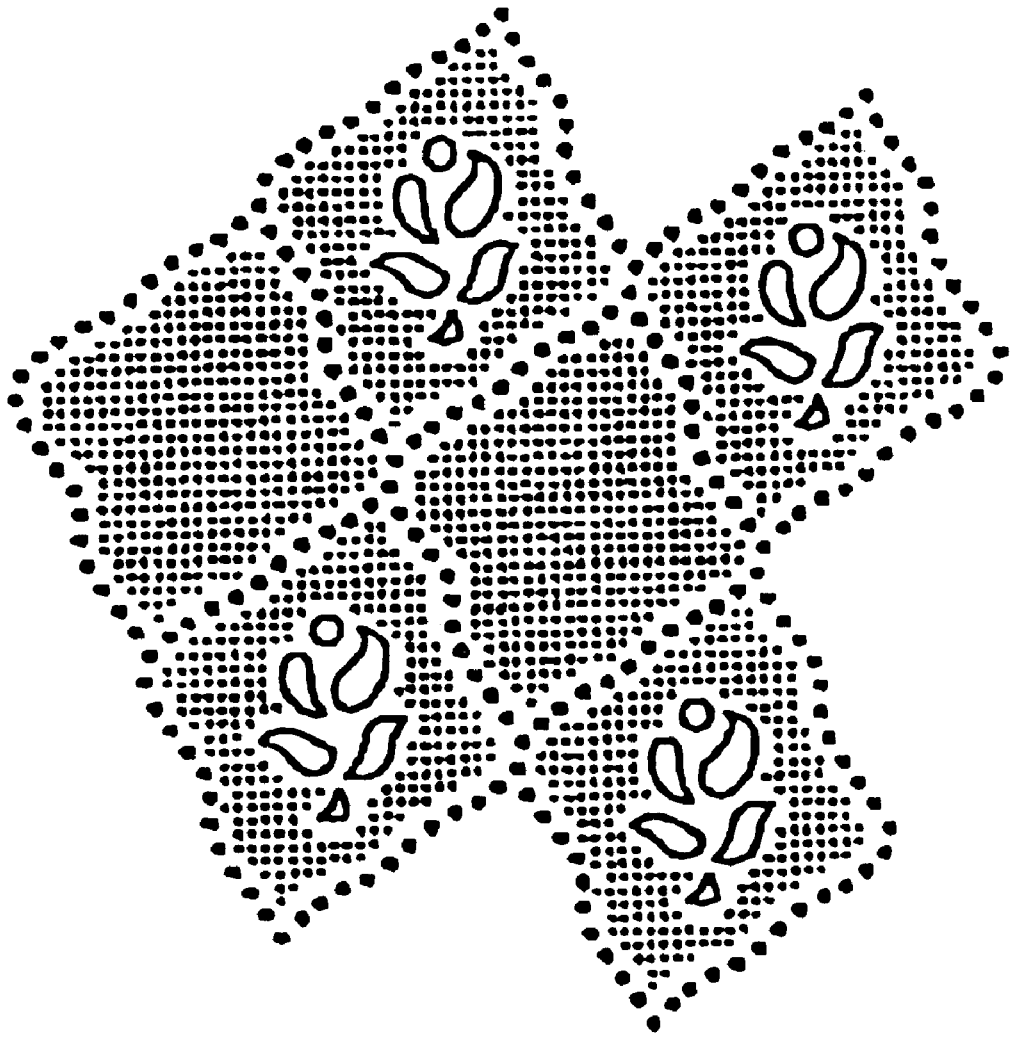
Figure 6:
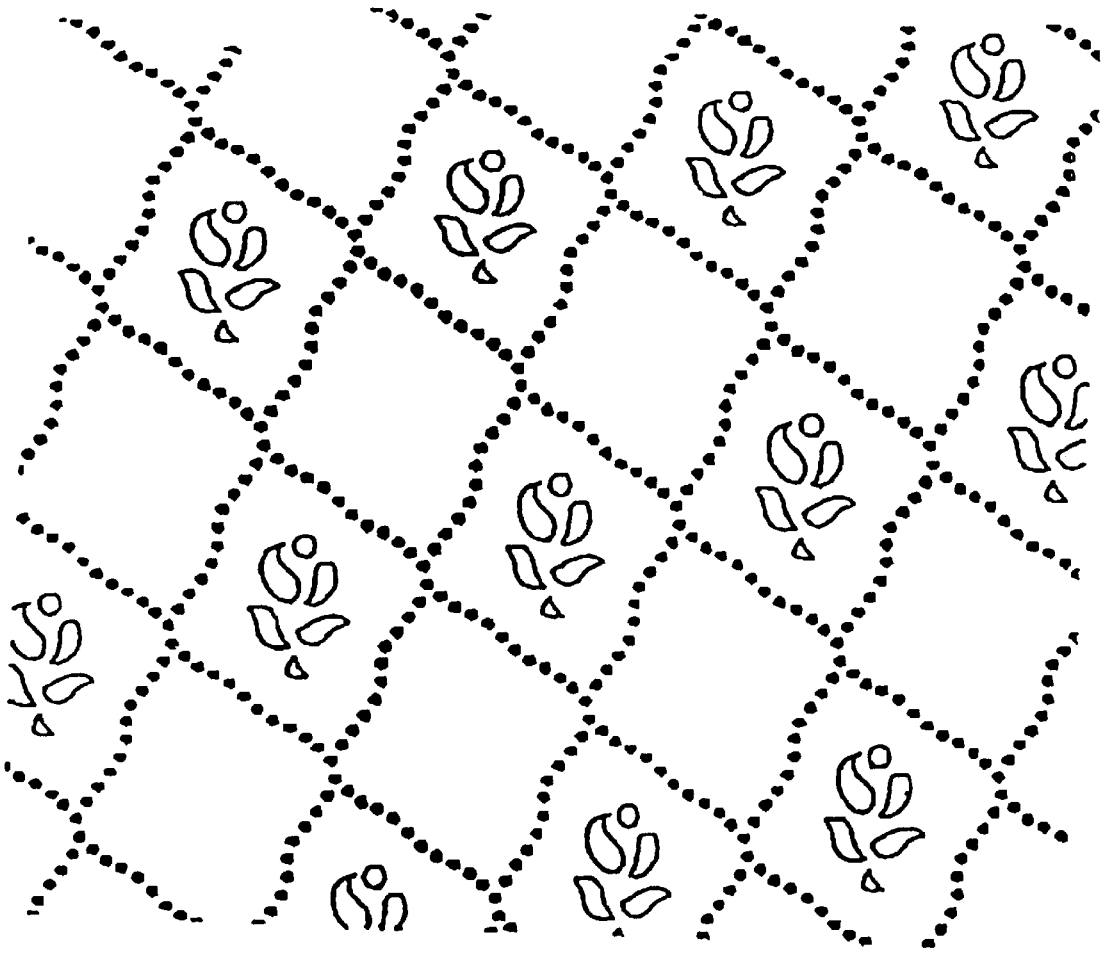
FIG. 6 illustrates a macro emboss pattern.
Figure 7:
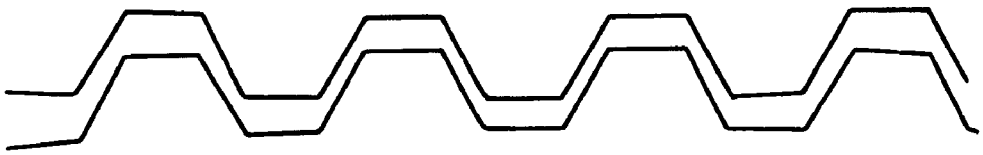
FIG. 7 illustrates the engagement of mated emboss rolls suitable to emboss the absorbent paper product of this invention.

In another preferred embodiment, one of the signature emboss patterns is made up of concentrically arranged elements. These elements can include like elements for example, a large circle around a smaller circle, or differing elements, for example a larger circle around a smaller heart. In a most preferred embodiment of the present invention, at least one of the signature emboss patterns are concentrically arranged hearts as can be seen in FIG. 3. The use of concentrically arranged emboss elements in one of the signature emboss patterns adds to the puffiness effect realized in the appearance of the absorbent paper product in the form of a one ply bathroom tissue or one-ply facial tissue. The puffiness associated with this arrangement is the result not only of appearance but also of an actual raising of the paper product upward. Again, in a most preferred embodiment, another signature emboss element is a flower. The fiber combination further enhances the bulk of the one-ply bathroom tissue and the one-ply facial tissue.

In one embodiment of the present invention, emboss elements are formed having the uppermost portions thereof formed into crenels and merlons, herein after referred to as "crenulated emboss elements." By analogy, the side of such an emboss element would resemble the top of a castle wall having spaced projections which are merlons and depressions there between which are crenels. In a preferred embodiment, at least one of the signature emboss patterns is formed of crenulated emboss elements. More preferably, the signature boss pattern is two concentrically arranged hearts, one or both of which is crenulated.

In a preferred embodiment of the present invention, the signature bosses have a height of between 10 thousandths and 90 thousandths of an inch. The crenels are preferably at a depth of at least 3 thousandths of an inch. It is understood that the use of merlons which are unequally spaced or which differ in height are embraced within the present invention.

According to the present invention, when the web or sheets are formed into a roll, the bathroom tissue is aligned so that the bosses are internal to the roll and the debossed side of the bathroom tissue is exposed. In the present invention, the boss pattern is offset from the machine direction in the cross direction, the machine direction being parallel to the free edge of the web, by more than 10° to less than 170°.

In one embodiment of the present invention, the boss pattern combines stitch-shaped bosses with a first signature boss made up of linear continuous embossments and a second signature boss pattern made up of crenulated embossments. The overall arrangement of the pattern is selected so that when the sheets are formed into a roll, the signature bosses fully overlap at a maximum of three locations in the roll, more preferably at least two locations, the outermost of these being at least a predetermined distance, e.g., about an eighth of an inch, inward from the exterior surface of the roll. Moreover, the overall average boss density is substantially uniform in the machine direction of each strip in the roll. The combined effect of this arrangement is that the rolls possess very good roll structure and very high bulk.

The signature bosses are substantially centrally disposed in the cells formed by the intersecting flowing lines and serve to greatly enhance the bulk of the tissue while also enhancing the distortion of the surface thereof. At least some of the signature bosses are continuous rather than stitch-shaped and can preferably be elongate. Other of the signature bosses are crenulated and, preferably, are also substantially centrally disposed in cells formed by the intersecting flowing lines. The signature bosses enhance the puffy or filled appearance of the sheet both by creating the illusion of shading as well as by creating actual shading due to displacement of the sheet apparently caused by puckering of surrounding regions due to the embossing or debossing of the signature bosses.

One preferred emboss pattern is made up of a wavy lattice of dot shaped bosses having hearts and flowers within the cells of the lattice. FIG. 3 is a depiction of a preferred emboss pattern for use with the present invention. It is also preferred that the emboss pattern of the present invention be formed, at least in part, of crenulated emboss elements. As previously discussed, a crenulated emboss element is one that has a wide base with smaller separated land areas at the apex, resembling, for example, the top of a castle wall. Such an emboss pattern further enhances the bulk and softness of the absorbent paper product. The emboss elements are preferably less than 100 thousandths of an inch in height, more preferably less than 80 thousandths of an inch, and most preferably 30 to 70 thousandths of an inch.

The basis weight of the single-ply bathroom tissue, facial tissue, or napkin is desirably from about 12.5 to about 25 lbs./3000 sq. ft. ream, preferably from about 17 to about 20 lbs./ream. The caliper of the absorbent paper product of the present invention may be measured using the Model II Electronic Thickness Tester available from the Thwing-Albert Instrument Company of Philadelphia, Pa. The caliper is measured on a sample consisting of a stack of eight sheets of the absorbent paper using a two-inch diameter anvil at a 539±10 gram dead weight load. Single-ply absorbent paper product of the present invention have a specific (normalized for basis weight) caliper after calendering and embossing of from about 2.6 to 4.2 mils per 8 plies of absorbent paper sheets per pound per 3000 square foot ream, the more preferred absorbent paper having a caliper of from about 2.8 to about 4.0, the most preferred absorbent papers have a caliper of from about 3.0 to about 3.8. In the papermaking art, it is known that the size of the roll in the final product is dependent on the caliper of a bathroom tissue and the number of sheets contained in the roll.

Tensile strength of the absorbent paper products produced in accordance with the present invention is measured in the machine direction and cross-machine direction on an Instron Model 4000: Series IX tensile tester with the gauge length set to 3 inches. The area of tissue tested is assumed to be 3 inches wide by 3 inches long. In practice, the length of the samples is the distance between lines of perforation in the case of machine direction tensile strength and the width of the samples is the width of the roll in the case of cross-machine direction tensile strength. A 20 pound load cell with heavyweight grips applied to the total width of the sample is employed. The maximum load is recorded for each direction. The results are reported in units of "grams per 3-inch"; a more complete rendering of the units would be "grams per 3-inch by 3-inch strip." The total (sum of machine and cross machine directions) dry specific tensile of the printed paper products of the present invention, when normalized for basis weight, will be between 40 and 200 grams per 3 inches per pound per 3000 square foot ream, suitably between 40 and 150 grams per 3 inches per 3000 square foot ream, preferably between 40 and 75 grams per 3 inches per 3000 square foot ream. The ratio of MD to CD tensile is also important and should be between 1.25 and 2.75, preferably between 1.5 and 2.5.

The wet tensile of the tissue of the present invention is measured using a three-inch wide strip of tissue that is folded into a loop, clamped in a special fixture termed a Finch Cup, then immersed in water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. The wet tensile of the absorbent paper of the present invention will be at least 2.75 grams per three inches per pound per 3000 square foot ream in the cross direction as measured using the Finch Cup and can have values of 7.5, 15 and 20 grams per three inches per pound per 3000 square foot ream when the absorbent paper product has a specific total tensile strength of about 75, 150 and 200 grams per 3 inches per pound per 3000 square foot ream respectively. Normally, only the cross direction wet tensile is tested, as the strength in this direction is normally lower than that of the machine direction and the absorbent paper is more likely to fail in use in the cross direction.

Softness is a quality that does not lend itself to easy quantification. J. D. Bates, in "Softness Index: Fact or Mirage?" *TAPPI*, Vol. 48 (1965), No. 4, pp. 63A–64A, indicates that the two most important readily quantifiable properties for predicting perceived softness are (a) roughness and (b) what may be referred to as stiffness modulus. Bathroom tissue, facial tissue, and napkin produced according to the present invention has a more pleasing texture as measured by sidedness parameter or reduced values of either or both roughness and stiffness modulus (relative to control samples). Surface roughness can be evaluated by measuring geometric mean deviation in the coefficient of friction (GM MMD) using a Kawabata KES-SE Friction Tester equipped with a fingerprint-type sensing unit using the low sensitivity range. A 25 g stylus weight is used, and the instrument readout is divided by 20 to obtain the mean deviation in the coefficient of friction. The geometric mean deviation in the coefficient of friction or overall surface friction is then the square root of the product of the deviation in the machine direction and the cross-machine direction. When the absorbent paper has a specific total tensile strength of between 40 and 75 grams per 3 inches per pound per 3000 square foot ream, the GM MMD of the single-ply paper product of the current invention is preferably no more than about 0.225, is more preferably less than about 0.215, and is most preferably about 0.150 to about 0.205. When the specific total tensile strength is between 150 and 200 grams per 3 inches per pound per 3000 square foot ream the GM MMD is no more than 0.250.

To quantify the degree of sidedness of a tissue product, a quantity that is termed sidedness parameter or S is used. The sidedness parameter S is defined as $$S = \frac{1}{2}\frac{[GM\ MMD]_H}{[GM\ MMD]_L}\{[GM\ MMD]_H + [GM\ MMD]_L\}$$

where $[GM\ MMD]_H$ and $[GM\ MMD]_L$ are respectively the higher and lower geometric mean friction deviations of the two sides of the tissue. For one-ply, CWP tissue products, the higher friction deviation is usually associated with the air side of the sheet. S takes into account not only the relative difference between the friction deviation of the two sides of the sheet, but also the overall friction deviation level. Accordingly, low S values are preferred. S values of less than 0.3 indicate that the tissue has low sidedness. Preferably, the sidedness parameter is about 0.15 to 0.225.

The tensile stiffness (also referred to as stiffness modulus) is determined by the procedure for measuring tensile strength described above, except that a sample width of 1 inch is used and the modulus recorded is the geometric mean of the ratio of 50 grams load over percent strain obtained from the load-strain curve. The specific tensile stiffness of said web is preferably from about 0.5 to about 1.2 g/inch/% strain per pound of basis weight and more preferably from about 0.6 to about 1.0 g/inch/% strain per pound of basis weight, most preferably from about 0.7 to about 0.8 g/inch/% strain per pound of basis weight. When the absorbent paper product has a specific total tensile strength of between 40 and 75 grams per 3 inches per pound per 3000 square foot ream, the specific geometric mean tensile stiffness is between 0.5 and 1.2 grams per inch per percent strain per pound per 3000 square foot ream. When the specific total tensile strength is between 40 and 150 grams per 3 inches per pound per 3000 square foot ream the specific geometric mean tensile stiffness is between 0.5 and 2.4 grams per inch per percent strain per pound per 3000 square foot ream and when the specific total tensile strength is between 40 and 200 grams per 3 inches per pound per 3000 square foot ream, the specific geometric mean tensile stiffness is between 0.5 and 3.2 grams per inch per percent strain per pound per 3000 square foot ream.

Formation of bathroom tissue or facial tissue of the present invention as represented by Kajaani Formation Index Number should be at least about 50, preferably about 55, more preferably at least about 60, and most preferably at least about 65, as determined by measurement of transmitted light intensity variations over the area of the sheet using a Kajaani Paperlab 1 Formation Analyzer which compares the transmitivity of about 250,000 subregions of the sheet. The Kajaani Formation Index Number, which varies between about 20 and 122, is widely used through the paper industry and is for practical purposes identical to the Robotest Number which is simply an older term for the same measurement.

*TAPPI* 401 OM-88 (Revised 1988) provides a procedure for the identification of the types of fibers present in a sample of paper or paperboard and an estimate of their quantity. Analysis of the amount of the softener/debonder chemicals retained on the printed absorbent paper of this invention can be performed by any method accepted in the applicable art. For the most sensitive cases, we prefer to use x-ray photoelectron spectroscopy ESCA to measure nitrogen levels, the amounts in each level being measurable by using the tape pull procedure described above combined with ESCA analysis of each "split." Normally the background level is quite high and the variation between measurements quite high, so use of several replicates in a relatively modern ESCA system such as at the Perkin Elmer Corporation's model 5,600 is required to obtain more precise measurements. The level of cationic nitrogenous softener/debonder such as Quasoft® 202-JR can alternatively be determined by solvent extraction of the Quasoft® 202-JR by an organic solvent followed by liquid chromatography determination of the softener/debonder. *TAPPI* 419 OM-85 provides the qualitative and quantitative methods for measuring total starch content. However, this procedure does not provide for the determination of starches that are cationic, substituted, grafted, or combined with resins. These types of starches can be determined by high pressure liquid chromatography. (*TAPPI*, Journal Vol. 76, Number 3.)

Fiber length and coarseness can be measured using a fiber-measuring instrument such as the Kajaani FS-200 analyzer available from Valmet Automation of Norcross, Ga. For fiber length measurements, a dilute suspension of the fibers (approximately 0.5 to 0.6 percent) whose length is to be measured is prepared in a sample beaker and the instrument operated according to the procedures recommended by the manufacturer. The report range for fiber lengths is set at a minimum value of 0.0 mm and a maximum value of 7.2 mm; fibers having lengths outside of this range are excluded. Three calculated average fiber lengths are reported. The arithmetic average length is the sum of the product of the number of fibers measured and the length of the fiber divided by the sum of the number of fibers measured. The length-weighted average fiber length is defined as the sum of the product of the number of fibers measured and the length of each fiber squared divided by the sum of the product of the number of fibers measured and the length the fiber. The weight-weighted average fiber length is defined as the sum of the product of the number of fibers measured and the length of the fiber cubed divided by the sum of the product of the number of fibers and the length of the fiber squared. It is the weight-weighted fiber length that is used in calculating the coarseness-to-length ratio specified in the invention.

Fiber coarseness is the weight of fibers in a sample per unit length and is usually reported as mg/100 meters. The fiber coarseness of a sample is measured from a pulp or paper sample that has been dried and then conditioned at 72 degrees Fahrenheit and 50% relative humidity for at least four hours. The fibers used in the coarseness measurement are removed from the sample using tweezers to avoid contamination. The weight of fiber that is chosen for the coarseness determination depends on the estimated fraction of hardwood and softwood in the sample and range from 3 mg for an all-hardwood sample to 14 mg for a sample composed entirely of softwood. The portion of the sample to be used in the coarseness measurement is weighed to the nearest 0.00001 gram and is then slurried in water. To insure that a uniform fiber suspension is obtained and that all fiber clumps are dispersed, an instrument such as the Soniprep 150, available from Sanyo Gallenkamp of Uxbridge, Middlesex, UK, is used to disperse the fiber. After dispersion, the fiber sample is transferred to a sample cup, taking care to insure that the entire sample is transferred. The cup is then placed in the Kajaani FS 200. The dry weight of pulp used in the measurement, which is calculated by multiplying the weight obtained above by 0.93 to compensate for the moisture in the fiber, is entered into the analyzer and the coarseness is determined using the procedure recommended by the manufacturer.

The following examples are not to be construed as limiting the invention as described herein.

EXAMPLE 1

Two one-ply tissue base sheets were made on a crescent former paper machine. The first of these sheets, made in accordance with the present invention, was homogeneously formed and had a furnish that contained 25% SWK which had a coarseness of 26.6 mg/100 m and a weight-weighted fiber length of 2.94 mm, and 35% HWK having a coarseness of 9.6 mg/100 m and a weight-weighted fiber length of 0.84 mm. The remainder of the sheet was composed of secondary fiber. The total fiber blend had a coarseness to length ratio of 7.55 mg/100 m/mm. To the furnish, 7 lbs/T of a wet strength starch and 2 lbs/T of an imidazoline-based debonder were added. The sheet was sprayed with 2 lbs/T of a spray softener while the sheet was on the felt. The second one-ply tissue base sheet was made as a three-layer stratified sheet. The sheet's two outer layers, each of which comprised 20% by weight of the total sheet, were composed of the same hardwood pulp as was used in the non-stratified sheet. The center layer of the sheet, which made up the remaining 60% of the sheet, was composed of a 3/2 blend of secondary fiber/softwood kraft, with these pulps being the same as those used in the homogenous sheet. Eight lbs/ton of a wet strength starch and 1.75 lbs/T of an imidazoline based debonder were added to the furnish. The starch was added to all three layers, while the debonder was added to the center layer only. The sheet was sprayed with 2 lbs/T of a spray softener while the sheet was on the felt. After forming, both base sheets were embossed using the mated embossing pattern of FIGS. 5A-1, 5A-2, 5A-3, 5B-1, 5B-2, 5B-3, 5-C and 5D and were wound to finished product rolls having 280 sheets. The physical properties of these finished products are given in Table 1 below.

EXAMPLE 2

A one-ply homogeneously-formed tissue sheet was formed from a furnish containing 40% softwood kraft fibers which had a coarseness of 29.1 mg/100 m and a weight-weighted fiber length of 3.13 mm, and 30% hardwood kraft fibers having a coarseness of 9.7 mg/100 m and a weight-weighted fiber length of 0.93 mm. The remainder of the tissue was composed of southern hardwood kraft fibers. The overall furnish had a weight average coarseness to length ratio of 8.08 mg/100 m/mm. A wet strength starch and an imidazoline-based debonder were added to the furnish in the amounts of 12 lbs/T and 0.5 lbs/T respectively. Two and one-half pounds/ton of a spray softener were applied to the sheet while it was on the felt. A second one-ply homogeneously-formed tissue sheet was formed from a furnish containing 35% softwood kraft fibers which had a coarseness of 29.1 mg/100 m and a weight-weighted fiber length of 3.13 mm, and 65% hardwood kraft fibers having a coarseness of 8.3 mg/100 m and a weight-weighted fiber of 0.93 mm. The overall furnish had a weight average coarseness to length ratio of 658/mg/100 m/mm. Nine pounds per ton of a wet-strength starch and 1.5 lbs/ton of a imidazoline-based debonder were added to the furnish. The sheet was sprayed with softener at a rate of 2.5 lbs/ton while it was on the felt. The base sheets were embossed using the mated emboss pattern of FIGS. 5A-1, 5A-2, 5A-3, 5B-1, 5B-2, 5B-3 and 5D and was wound to a finished product roll having 280 sheets. The physical properties of the one-ply sheet made in accordance with the current invention are shown in Table 2 below.

TABLE 1

| Product # | Basis Weight lb/ream | Caliper mil/ 8 sht | MD Tensile gr/3 in | CD Tensile gr/3 in | MD Stretch % | CD Stretch % | Tensile Stiffness gr/in/% | Friction Deviation | Specific Caliper mil/ 8 sht/ lb/ream | Specific Total Tensile gr/3 in/ lb/ream | CD Specific Wet Tensile gr/3 in/ lb/ream | Specific Tensile Stiffness gr/in/%/ lb/ream | Sidedness |
|---|---|---|---|---|---|---|---|---|---|---|---|---|---|
| 1 | 17.8 | 70.1 | 616 | 297 | 19.8 | 7.3 | 12.0 | 0.198 | 3.94 | 51.3 | 3.8 | 0.67 | 0.216 |
| 2 | 17.9 | 69.7 | 630 | 345 | 18.8 | 7.1 | 13.5 | 0.202 | 3.89 | 54.5 | 4.0 | 0.75 | 0.240 |

The two one-ply products were tested by a trained sensory panel for softness and bulk. The homogeneously formed tissue of the present invention was measured by the panel to have a sensory softness of 17.57 vs. a softness value of 17.34 for the three-layered product. The sensory bulk of the homogenous product was −0.36, as compared to a value of −0.63 that was measured for the layered product. Thus, it can be seen that use of the present invention can produce a one-ply tissue product at least equal to a product that employs three-layer stratification, without the necessity of an expensive three-layer headbox and stock delivery system.

TABLE 2

| Product # | Basis Weight lb/ream | Caliper mil/ 8 sht | MD Tensile gr/3 in | CD Tensile gr/3 in | MD Stretch % | CD Stretch % | Tensile Stiffness gr/in/% | Friction Deviation | Specific Caliper mil/ 8 sht/ lb/ream | Specific Total Tensile gr/3 in/ lb/ream | CD Specific Wet Tensile gr/3 in/ lb/ream | Specific Tensile Stiffness gr/in/%/ lb/ream | Sidedness |
|---|---|---|---|---|---|---|---|---|---|---|---|---|---|
| 1 | 18.4 | 64.9 | 633 | 346 | 25.0 | 7.0 | 13.6 | 0.203 | 3.53 | 53.2 | 3.3 | 0.74 | 0.233 |
| 2 | 18.5 | 66.3 | 629 | 323 | 23.7 | 6.8 | 11.6 | 0.203 | 3.58 | 51.5 | 3.1 | 0.63 | 0.239 |

The products were tested by consumers in Monadic Home Use Tests. In this type of test, consumers test a single product and are then asked to rate its overall performance as well as its performance in several attribute categories. These attributes can be ranked as Excellent, Very Good, Good, Fair, or Poor. For tabulation purposes, each response is assigned a numerical value ranging from 5 for a rating of Excellent to 1 for a Poor rating. A weighted average rating for the tissue's Overall Rating as well as each attribute can then be calculated. The Monadic Home-Use tests are described in the Blumenship and Green textbook, *State of The Art Marketing Research*, NTC Publishing Group, Lincolnwood, Ill., 1993. The results of these test are shown in Table 3, which lists the consumer rating of the product for overall performance and for several important tissue properties. As a reference Monadic Home Use Test scores for several commercially available two-ply CWP and a one-ply TAD product are also given.

TABLE 3

| Product Type | Overall Rating | Softness Rating | Strength Rating | Thickness Rating | Absorbency Rating |
|---|---|---|---|---|---|
| Two-Ply CWP | 3.87 | 4.12 | 4.01 | 3.77 | 4.09 |
| Two-Ply CWP | 3.68 | 3.73 | 3.78 | 3.44 | 3.82 |
| Two-Ply CWP | 3.32 | 3.59 | 3.44 | 3.38 | 3.57 |
| Two-Ply CWP | 3.84 | 4.22 | 4.00 | 3.93 | 4.06 |
| Two-Ply CWP | 3.69 | 3.93 | 3.88 | 3.78 | 4.00 |
| Two-Ply CWP | 3.47 | 3.79 | 3.81 | 3.37 | 3.84 |
| Two-Ply CWP | 3.29 | 3.30 | 3.48 | 3.30 | 3.52 |
| One-Ply TAD | 3.74 | 4.09 | 3.98 | 3.95 | 3.95 |
| Current Invention (1) | 3.71 | 3.85 | 3.94 | 3.68 | 3.88 |
| Current Invention (2) | 3.93 | 4.10 | 4.01 | 3.78 | 3.99 |

As can be seen from Table 3, the one-ply, homogeneously-formed, CWP tissues of the current invention is perceived by consumers as being equivalent in quality to commercially available two-ply CWP and one-ply TAD products for overall performance and for important tissue attributes.

EXAMPLE 3

This example illustrates that a lower weight average coarseness to length ratio corresponds to a higher sensory softness for a variety of fiber blends and fiber types.

Eight one-ply homogeneously-formed tissue prototypes were produced from a variety of furnish blends. The constituent pulps that were used in creating the various fiber blends and their properties are shown in Table 4 below.

TABLE 4

| Fiber Designation | Fiber Type | Fiber Coarseness (mg/100 meters) | Fiber Length-Weight Weighted (mm) |
|---|---|---|---|
| A | Softwood Kraft | 29.1 | 3.13 |
| B | Softwood Kraft | 19.1 | 2.79 |
| G | Hardwood Kraft | 8.3 | 0.93 |
| D | Hardwood Kraft | 9.7 | 0.93 |
| E | Hardwood Kraft | 12.8 | 1.35 |
| F | Secondary Fiber | 14.8 | 1.78 |

Each of the fiber blends was treated with a wet-strength enhancing starch and an imidazoline-based debonder. The add-on levels of the starch and debonder were varied to produce base sheets having approximately the same wet and dry tensile strengths. The sheets were also sprayed with 2.5 lbs/ton of a softener, which was applied to the sheet while it was on the felt. Table 5 below shows the combination of pulps that were used in each blend along with the amounts of wet strength starch and debonder that was used in the manufacture of each base sheet. The pulp blends that were created by the mixing of the various furnishes had weight average coarseness to length ratios ranging from about 6 to about 8.

TABLE 5

| Proto-type | Furnish Blend | Wet-Strength Starch Addition (lbs/ton) | Wet-End Debonder Addition (lbs/ton) |
|---|---|---|---|
| 1 | 35% A + 65% C | 9 | 1.5 |
| 2 | 50% A + 50% C | 9 | 0.5 |
| 3 | 65% A + 35% C | 10 | 0.5 |
| 4 | 65% B + 35% C | 10 | 3.0 |
| 5 | 10% B + 40% E + 50% F | 12 | 3.5 |
| 6 | 30% B + 40% D + 30% F | 10 | 4.0 |
| 7 | 40% A + 30% D + 30% E | 12 | 0.5 |
| 8 | 50% A + 50% D | 12 | 1.5 |

Figure 1:
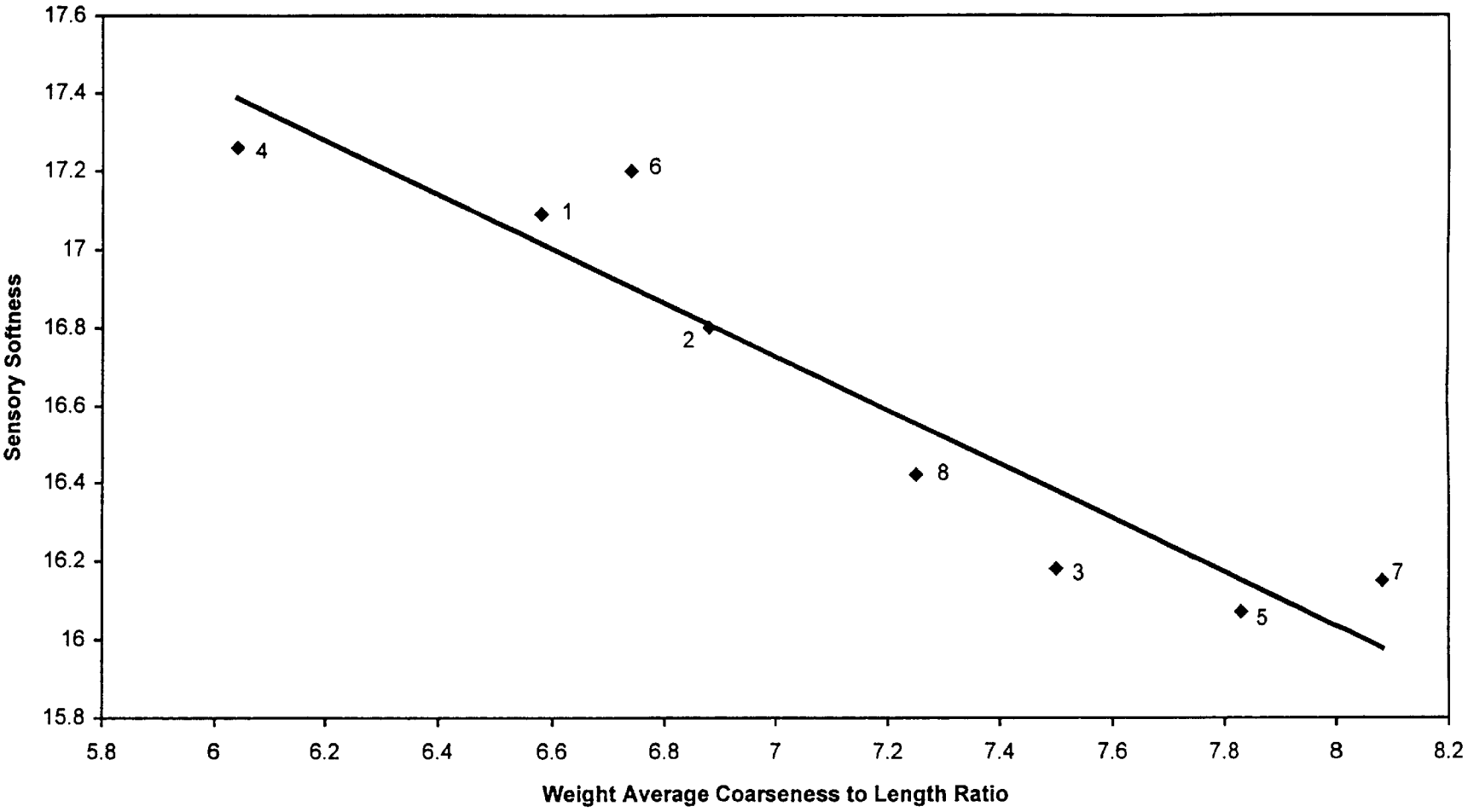
FIG. 1 illustrates the one-ply bathroom tissue softness as a function of furnish coarseness to furnish length ratio.

The base sheets were embossed using the emboss pattern of FIG. 3 to create finished products. The emboss penetration depth was 0.100 inches for all eight products. All products were wound to create rolls containing 280 sheets. The products were tested for sensory softness by a trained panel. The softness values of the products as a function of their weight average coarseness to length ratios are shown in FIG. 1. This figure illustrates that products having lower weight average coarseness to length ratios have higher softness values for a diverse group of fiber blends made up of a variety of fiber types.

EXAMPLE 4

Two of the products from Example 3, product #1 and product #4 were selected for closer examination. As can be seen from FIG. 1, these two products are made from furnish blends that have a similar weight average coarseness to length ratio even though hardwood and softwood percentages of the two products are quite different. Product #1 contains primarily hardwood along with some high-coarseness softwood, while product #4 made chiefly from low-coarseness softwood fibers, along with some hardwood. As is shown in Table 6, the physical properties of the two embossed tissue products are also similar, except that the formation of product #1 is higher than that of product #4. This higher formation is probably a consequence of product #1's higher hardwood content, as formation and hardwood content tend to be positively correlated.

TABLE 6

| Product # | Basis Weight lbs/ ream | Caliper mils/ 8 sheet | MD Tensile gr/3" | CD Tensile gr/3" | MD Stretch % | CD Stretch % | CD Wet Tensile gr/3" | Tensile Stiff-ness gr/in/% | Friction Devia-tion | Forma-tion |
|---|---|---|---|---|---|---|---|---|---|---|
| 1 | 19.22 | 73.9 | 757 | 380 | 25.0 | 6.2 | 73 | 13.3 | 0.195 | 79.7 |
| 4 | 18.93 | 72.7 | 761 | 428 | 27.7 | 6.5 | 85 | 12.0 | 0.178 | 72.8 |

| | Specific Caliper mils/8 sheet/lb/ream | Specific Total Tensile gr/3"/lb/ream | CD Specific Wet Tensile gr/3"/lb/ream | Specific Tensile Stiffness gr/in/%/lb/ream | Sidedness |
|---|---|---|---|---|---|
| 1 | 3.84 | 59.2 | 3.8 | 0.69 | — |
| 4 | 3.84 | 62.8 | 4.5 | 0.63 | — |

The sensory softness, as measured by a trained panel, was similar for both products as is shown in FIG. 1. The same trained panel also measured the sensory bulk of both products. In this test, the bulk of a product is compared by the panelist to that of a standard tissue whose bulk value is arbitrarily set to 0.0. Product #1 was found to have a bulk of 0.17, while product #4 had a bulk value of 0.02. Both of these products have softness and bulk values that are in the range of values measured for premium one-ply TAD and two-ply CWP products currently available.

Although, the two products have similar overall quality, the product made according to the current invention, product #1, has some advantages over product #4, which employs only low coarseness softwoods and hardwoods. First, product #1 contains substantially less softwood than does product #4. In general, softwoods are more expensive to produce than are hardwoods. Second, the high-coarseness softwood of product #1, which, in this case, is made from Southern Pine, is often less expensive than is the low-coarseness softwood that is contained in Product #4. The higher formation of product #1 also provides an advantage for one-ply products. It is essential that one-ply tissues provide good fiber "cover" with a single tissue sheet, as these products do not have the luxury of hiding areas of poor formation with a second sheet, as can be done in a two-ply product. This formation advantage will be of particular importance for one-ply tissues produced on older CWP machines, as many of these machines, because of limitations in headbox and approach piping design and capacity, are limited in the headbox dilution levels that are practical during tissue manufacture. By providing a CWP product that has good bulk at relatively low levels of softwood, the present invention provides the opportunity to produce well-formed CWP tissue sheets, even on older, dilution-limited machines operating at the higher fiber throughput levels associated with the manufacture of single-ply tissue products.

EXAMPLE 5

An aqueous dispersion of softener was made by mixing appropriate amount with deionized water at room temperature. Mixing was accomplished by using a magnetic stirrer operated at moderate speeds for a period of one minute. The composition of softener dispersion is shown in Table 7 below.

TABLE 7

| Composition | Weight (%) |
|---|---|
| imidazoline | 67.00 |
| TMPD (2,2,4 trimethyl 1,3 pentane diol) | 9.24 |
| TMPD-1EO (ethoxylated TMPD) | 14.19 |
| TMPD-2EO (ethoxylated TMPD) | 6.60 |
| TMPD-3EO (ethoxylated TMPD) | 1.32 |
| TMPD-4EO (ethoxylated TMPD) | 0.66 |
| Other | 0.99 |

Depending on the concentration of softener in water, the viscosity can range from 20 to 800 cp. at room temperature. A unique feature of this dispersion is its stability under high ultracentrifugation. An ultracentrifuge is a very high speed centrifuge in which the centrifugal force of rotation is substituted for the force of gravity. By whirling colloidal dispersions in cells placed in specially designed rotors, accelerations as high as one million times that of gravity can be achieved. When this dispersion was subjected to ultracentrifugation for 8 minutes at 7000 rpm, no separation of the dispersion occurred. The distribution of the particle size of softener in the dispersion as measured by the Nicomp Submicron particle size analyzer is presented in Table 8.

TABLE 8

| Weight % | Particle Size (nanometers) |
|---|---|
| 12 | 162 |
| 88 | 685 |

EXAMPLE 6

In order to understand the mechanism of retention and softening attributed to V475/TMPD-1EO when applied to tissue products of this invention, data was obtained on the particle size distributions of water dispersions of V475/TMPD-1EO and V475/PG. The 475/TMPD-1EO formulation contained 75% V475 and 25% TMPD-1EO. The V475/PG formulation contained 90% V475 and 10% propylene glycol. The dispersions were prepared using either boiling water (100° C.) or room temperature water (22°) and mixed for 2 minutes using either high or low shear conditions. In all cases, the dispersions were 5% by weight in V475. Low shear was defined as mixing with a magnetic stirrer using a 1 inch stir bar for 2 minutes at approximately 1000 rpm. High shear was defined as mixing with a Waring blender using a 4-blade propeller for 2 minutes at approximately 10,000 rpm. Speed of rotation was measured with a stroboscope.

The Nicomp, Model 270 submicron particle size analyzer was used to measure the particle size distribution for each dispersion. The data show that V475/PG could not be dispersed in room temperature water with a magnetic stirrer. The V475/PG could be dispersed in room temperature water when mixed under high shear conditions.

Our data demonstrate that extremely small particle size, less than 20nm, usually about 15 nm were obtained with V475/TMPD-1EO formulation when mixed with boiling water under high shear conditions. Under the same conditions of temperature and shear, the smallest particle sized obtained with the V475/PG formulation were in the 200nm range. The presence of TMPD aids in producing dispersions that have a higher population of smaller particles. Particle size may play a roll in differentiating the performance of the PG and TMPD versions of V475. Some of these particles are small enough to enter the walls of the fiber. It is believed that the softener which penetrates the fiber wall has improved product performance compared to softeners which remain completely on the surface of the fiber. The results are set forth in Table 9.

TABLE 9

| | Low Shear, 22° C. | | Low Shear, 100° C. | | High Shear, 22° C. | | High Shear, 100° C. | |
|---|---|---|---|---|---|---|---|---|
| Sample | Size (nm) | Vol. % | Size (nm) | Vol. % | Size (nm) | Vol. % | Size (nm) | Vol. % |
| TMPD | 695 | 94 | 1005 | 92 | 160 | 74 | 238 | 1 |
| | 135 | 6 | 218 | 8 | 51 | 26 | 57 | 22 |
| | | | | | | | 15 | 77 |
| PG | Could Not Disperse | | 960 | 94 | 224 | 100 | 193 | 100 |
| | | | 188 | 6 | | | | |

We claim:

1. An improved homogeneous, high-softness, high-bulk cellulosic absorbent paper product of the type comprising a wet laid web of cellulosic fibers wherein the improvement comprises selecting the cellulosic fibers incorporated in the furnish for said web such that:

(a) at least 20 percent by weight of the fibers in the web have a coarseness exceeding 23 mg/100 m;

(b) at least about 20 percent by weight of the fibers in the web have a coarseness of less than about 12 mg/100 m; and (c) the weight average coarseness to length ratio of the fibers in the web is less than about 8.5 mg/100 m/mm.

2. The soft, absorbent paper product of claim 1 having a serpentine configuration and a basis weight of at least about 12.5 lbs./3000 sq. ft. ream and having low sidedness, said single-ply absorbent paper formed by conventional wet pressing of a cellulosic web, adhering said web to a Yankee dryer and creping the web from the Yankee dryer, said absorbent paper including:

(a) a temporary wet strength agent comprising an organic moiety, and (b) nitrogenous softener agent, the amount of the temporary wet strength agent, and the nitrogenous softener added being sufficient to produce an absorbent paper having a serpentine configuration and a specific total tensile strength of between 40 and 200 grams per 3 inches per pound per 3000 square foot ream, a cross direction specific wet tensile strength of between 2.75 and 20.0 grams per 3 inches per pound per 3000 square foot ream, the ratio of MD tensile to CD tensile of between 1.25 and 2.75, a specific geometric mean tensile stiffness of between 0.5 and 3.2 grams per inch per percent strain per pound per 3000 square foot ream, a friction deviation of less than 0.250, and a sidedness parameter of less than 0.30.

3. The absorbent paper product of claim 1 or claim 2 in the form of a one-ply napkin.

4. The absorbent paper of claim 2 wherein the absorbent paper product exhibits a specific total tensile strength of between 40 and 150 grams per 3 inches per pound per 3000 square foot ream a cross direction specific wet tensile strength between 2.75 and 15 grams per 3 inches per 3000 square foot ream, a specific geometric mean tensile stiffness of between 0.5 and 2.4 grams per inch per percent strain per pound per 3000 square foot ream, a friction deviation of less than 0.250 and sidedness parameter of less than 0.30.

5. The absorbent paper of claim 4 wherein the absorbent paper product exhibits a specific tensile strength between 40 and 75 grams per 3 inches per 3000 square foot ream, a cross direction specific wet tensile strength of between 2.75 and 7.5 grams per 3 inches per pound per 3000 square foot ream, a specific geometric mean tensile stiffness of between 0.5 and 1.2 grams per inch per percent strain per pound per 3000 square foot ream, a friction deviation of less than 0.225; and a sidedness parameter of less than 0.275.

6. The single-ply absorbent paper product of claim 2 wherein the cationic nitrogenous softener has a melting range of about 0° C. to 40° C. wherein the softener comprises an imidazoline moiety formulated with organic compounds selected from the group consisting of aliphatic polyols, aliphatic diols, alkoxylated aliphatic polyols, alkoxylated aliphatic diols, and mixtures of these compounds.

7. The absorbent paper product of claim 6 wherein the softener is dispersible in water at a temperature of about 1° C. to 100° C.

8. The absorbent paper product of claim 6 wherein the softener is dispersible in water at a temperature of about 1° C. to 40° C.

9. The absorbent paper product of claim 6 in the form of a single-ply bathroom tissue.

10. The absorbent paper product of claim 6 in the form of a single-ply napkin.

11. The absorbent paper of claim 6 wherein the imidazoline moiety is of the following formula:

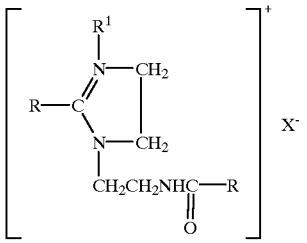

wherein X is an anion and R is selected from the group of saturated and unsaturated paraffinic moieties having a carbon chain length of $C_{12}$ to $C_{20}$ and $R^1$ is selected from the group of saturated paraffinic moieties having a carbon chain length of 1 to 3 carbon atoms.

12. The absorbent paper product of claim 11 wherein X is selected from the group of methyl sulfate and ethyl sulfate.

13. The absorbent paper product of claim 11 wherein X is chloride ion.

14. The absorbent paper product of claim 11 wherein R has a chain length of $C_{12}$ to $C_{18}$.

15. The absorbent paper product of claim 11 wherein R has a chain length of $C_{16}$ to $C_{18}$.

16. The absorbent paper product of claim in the form of a single-ply bathroom tissue.

17. The absorbent paper of claim 1 wherein the weight-weighted average fiber length of the fibers in the web is greater than about 1.75 mm.

18. Soft, embossed, one-ply absorbent paper product of claim 1, said absorbent paper product having a serpentine configuration and a basis weight of at least about 12.5 lbs./3000 sq. ft. ream and exhibiting low sidedness, said one-ply absorbent paper formed by conventional wet pressing of a cellulosic web, adhering said web to a Yankee dryer and creping the web from the Yankee dryer, said absorbent paper including:

(a) a temporary wet strength agent comprising an organic moiety, and (b) nitrogenous softener agent, the amount of the temporary wet strength agent, and the nitrogenous softener added being sufficient to produce a one-ply tissue having a specific total tensile strength of between 40 and 200 grams per 3 inches per pound per 3000 square foot ream, a cross direction specific wet tensile strength of between 2.75 and 20.0 grams per 3 inches per pound per 3000 square foot ream, the ratio of MD tensile to CD tensile of between 1.25 and 2.75, a specific geometric mean tensile stiffness of between 0.5 and 3.2 grams per inch per percent strain per pound per 3000 square foot ream, a friction deviation of less than 0.250, and a sidedness parameter of less than 0.30.

19. The absorbent paper of claim 18 wherein the absorbent paper product exhibits a specific total tensile strength of between 40 and 150 grams per 3 inches per pound per 3000 square foot ream a cross direction specific wet tensile strength between 2.75 and 15 grams per 3 inches per 3000 square foot ream, a specific geometric mean tensile stiffness of between 0.5 and 2.4 grams per inch per percent strain per pound per 3000 square foot ream, a friction deviation of less than 0.250 and sidedness parameter of less than 0.30.

20. The absorbent paper of claim 19 wherein the absorbent paper product exhibits a specific tensile strength between 40 and 75 grams per 3 inches per 3000 square foot ream, a cross direction specific wet tensile strength of between 2.75 and 7.5 grams per 3 inches per pound per 3000 square foot ream, a specific geometric mean tensile stiffness of between 0.5 and 1.2 grams per inch per percent strain per pound per 3000 square foot ream, a friction deviation of less than 0.225; and a sidedness parameter of less than 0.275.

21. The absorbent paper product of claim 20 wherein the nitrogenous softener agent is a cationic nitrogenous softener agent.

22. The absorbent paper product of claim 20 wherein the temporary wet strength agent is selected from the group of uncharged organic compounds having aldehydic units and water soluble organic polymers comprising aldehydic units and cationic units.

23. The absorbent, embossed paper product of claim 18 in the form of a single-ply bathroom tissue.

24. The absorbent paper product of claim 18 in the form of a one-ply napkin.

25. The absorbent paper product of claim 1 wherein the tensile stiffness of the absorbent paper product is controlled within the range of less than 0.95 g/% strain per pound per 3000 square foot ream and the geometric mean friction deviation of the absorbent paper product is controlled to less than 0.210.

26. The absorbent paper product of claim 1 wherein the amount of said temporary wet strength agent added is controlled to produce a ratio of cross direction wet tensile strength to cross direction dry tensile of over at least about 15%.

27. The absorbent paper product of claim 26 wherein processing and calendering of said absorbent paper product is controlled to produce a GM MMD friction of from about 0.150 to 0.200 and a specific modulus of from about 0.6 to 0.8 g/inch/% strain/lb/3000 square foot ream.

28. The absorbent paper product of claim 1 wherein the specific tensile stiffness of the absorbent paper product is controlled within the range of less than 0.80 g/% strain/lb/3000 square foot ream and the GM MMD of the absorbent paper product is controlled to less than 0.200.

29. The absorbent paper product of claim 1 wherein the ratio of machine direction dry tensile strength to cross direction dry tensile strength is no more than about 2.25.

30. The absorbent paper product of claim 1 wherein the temporary wet strength agent is in the form of a cationic water soluble organic polymer having aldehyde groups in its moiety.

31. The absorbent paper product of claim 1 wherein the temporary wet strength agent is selected from the group consisting of glyoxal, polymeric starch, including charged aldehyde moieties, uncharged aldehydes, uncharged aldehyde-containing: (a) polymers, (b) polyols, (c) cyclic ureas, and mixtures of all or some of these temporary wet strength agents.

32. The absorbent paper of claim 1 wherein after creping, the web is optionally calendered and wherein the web is embossed between mated emboss rolls, each of which contain both male and female elements.

33. An improved homogeneous, high-softness, high-bulk cellulosic one-ply bathroom tissue product of the type comprising a wet laid web of cellulosic fibers wherein the improvement comprises selecting the cellulosic fibers incorporated in the furnish for said web such that:

(a) at least 20 percent by weight of the fibers in the web have a coarseness exceeding 23 mg/100 m;

(b) at least about 20 percent by weight of the fibers in the web have a coarseness of less than about 12 mg/100 m; and (c) the weight average coarseness to length ratio of the fibers in the web is less than about 8.5 mg/100 m/mm.

34. The one-ply bathroom tissue of claim 33 wherein the weight-weighted average fiber length of the fibers in the web is greater than about 1.75 mm.

35. The soft, one-ply bathroom tissue product of claim 33 having a serpentine configuration and a basis weight of at least about 12.5 lbs./3000 sq. ft. ream and having low sidedness, said single-ply absorbent paper formed by conventional wet pressing of a cellulosic web, adhering said web to a Yankee dryer and creping the web from the Yankee dryer, said absorbent paper including:

(a) a temporary wet strength agent comprising an organic moiety, and (b) nitrogenous softener agent, the amount of the temporary wet strength agent, and the nitrogenous softener added being sufficient to produce a one-ply bathroom tissue having a serpentine configuration and a specific total tensile strength of between 40 and 200 grams per 3 inches per pound per 3000 square foot ream, a cross direction specific wet tensile strength of between 2.75 and 20.0 grams per 3 inches per pound per 3000 square foot ream, the ratio of MD tensile to CD tensile of between 1.25 and 2.75, a specific geometric mean tensile stiffness of between 0.5 and 3.2 grams per inch per percent strain per pound per 3000 square foot ream, a friction deviation of less than 0.250, and a sidedness parameter of less than 0.30.

36. The one-ply bathroom tissue of claim 35 wherein the absorbent paper product exhibits a specific total tensile strength of between 40 and 150 grams per 3 inches per pound per 3000 square foot ream a cross direction specific wet tensile strength between 2.75 and 15 grams per 3 inches per 3000 square foot ream, a specific geometric mean tensile stiffness of between 0.5 and 2.4 grams per inch per percent strain per pound per 3000 square foot ream, a friction deviation of less than 0.250 and sidedness parameter of less than 0.30.

37. The one-ply bathroom tissue of claim 36 wherein the one-ply bathroom tissue exhibits a specific tensile strength between 40 and 75 grams per 3 inches per 3000 square foot ream, a cross direction specific wet tensile strength of between 2.75 and 7.5 grams per 3 inches per pound per 3000 square foot ream, a specific geometric mean tensile stiffness of between 0.5 and 1.2 grams per inch per percent strain per pound per 3000 square foot ream, a friction deviation of less than 0.225; and a sidedness parameter of less than 0.275.

38. The bathroom tissue of claim 36 which has been embossed and exhibits puffiness and bulk having a plurality of bosses formed therein and wherein the bosses comprise a plurality of stitch-shaped bosses arrayed to form polygonal cells making up a lattice structure; and a plurality of bosses forming a first signature emboss pattern being centrally arrayed within a plurality of cells, said first signature bosses being formed of linear continuous embossments at a height exceeding 3 thousandths of an inch and a height less than 120 thousandths of an inch;

a plurality of bosses forming a second signature emboss pattern being centrally arrayed within a plurality of cells, said second signature bosses being formed of linear crenulated embossments at a height less than 120 thousandths of an inch and defining a plurality of merlons and crenels, wherein said crenels extend to a depth of at least 2 thousandths of an inch.

39. The bathroom tissue according to claim 38 wherein the combination of lattice structure and signature bosses are offset from the machine direction.

40. The bathroom tissue according to claim 39 wherein the combination is offset from about 15 to 65 degrees from the machine direction.

41. The bathroom tissue according to claim 38 wherein the continuous signature bosses have a height of about 40 to 80 thousandths of an inch and the crenulated signature bosses have a height of about 40 to 80 thousandths of an inch.

42. The bathroom tissue according to claim 38 wherein the stitch-shaped bosses have a height of about 40 to 80 thousandths of an inch.

43. The bathroom tissue according to claim 38 wherein the diameter of the stitch-shaped boss is at least one and one-half times the width of a line of the continuous or crenulated signature boss.

44. The bathroom tissue according to claim 38 wherein the diameter of the stitch-shaped boss is at least twice the width of a line of the continuous or crenulated signature boss.

45. The bathroom tissue according to claim 38 wherein the diameter of the stitch-shaped boss is at least three times the width of a line of the continuous or crenulated signature boss.

46. The bathroom tissue according to claim 38 wherein said polygonal cells are diamond shaped cells.

47. The bathroom tissue according to claim 38 wherein said tissue is approximately 3 polygonal cells wide.

48. The bathroom tissue according to claim 38 wherein the polygonal cells have generator lines which connect the apices of the polygonal cells and wherein the center of the stitch-shaped boss farthest from the generator line is a distance equivalent to at least 1 diameter of said stitch-shaped boss but no more than 3 diameters of said stitch-shaped boss from said line.

49. The bathroom tissue according to claim 38 wherein the stitch-shaped bosses are substantially circular dots.

50. The bathroom tissue according to claim 38 wherein the stitch-shaped bosses resemble dashes.

51. The bathroom tissue according to claim 50 wherein the dashes have an aspect ratio of less than 5.

52. The bathroom tissue according to claim 38 wherein the polygonal cells are hexagonal cells.

53. The bathroom tissue according to claim 38 wherein the polygonal cells are octagonal cells.

54. The bathroom tissue according to claim 38 wherein the crenulated signature bosses are configured as two concentrically arranged hearts.

55. The one-ply bathroom tissue of claim 35 wherein the nitrogenous softener agent is a cationic nitrogenous softener agent.

56. The bathroom tissue of claim wherein 55 the nitrogenous softener/debonder is selected from the group consisting of imidazolines, amido amine salts, linear amido amines, tetravalent ammonium salts, and mixtures thereof.

57. The bathroom tissue of claim 56 wherein the softener is an imidazoline in combination with an alcohol or a diol wherein the imidazoline has been rendered water soluble.

58. The bathroom tissue of claim 57 wherein the imidazoline is water dispersible.

59. The bathroom tissue of claim 55 wherein the salt has the following structure:

$$[(RCO)_2EDA]HX$$

wherein EDA is a diethylenetriamine residue, R is the residue of a fatty acid having from 12 to 22 carbon atoms, and X is an anion.

60. The bathroom tissue of claim 55 wherein the salt has the following structure:

$$[(RCONHCH_2CH_2)_2NR']HX$$

wherein R is the residue of a fatty acid having from 12 to 22 carbon atoms, R' is a lower alkyl group, and X is an anion.

61. The bathroom tissue of claim 55 wherein the softener/debonder is a mixture of linear amido amines and imidazolines of the following structure:

(i)

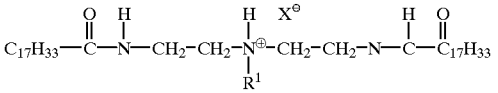

and (ii)

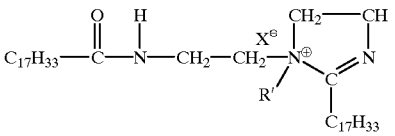

wherein X is an anion.

62. The bathroom tissue of claim 55 wherein the softener is an imidazoline in combination with an alcohol or a diol wherein the imidazoline has been rendered water soluble.

63. The bathroom tissue of claim 62 wherein the imidazoline is water dispersible.

64. The bathroom tissue of claim 55 wherein the salt has the following structure:

$$[(RCO)_2EDA]HX$$

wherein EDA is a diethylenetriamine residue, R is the residue of a fatty acid having from 12 to 22 carbon atoms, and X is an anion.

65. The bathroom tissue of claim 55 wherein the salt has the following structure:

$$[(RCONHCH_2CH_2)_2NR']HX$$

wherein R is the residue of a fatty acid having from 12 to 22 carbon atoms, R' is a lower alkyl group, and X is an anion.

66. The bathroom tissue of claim 55 wherein the softener/debonder is a mixture of linear amido amines and imidazolines of the following structure:

(i)

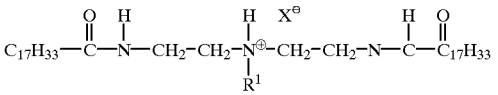

and (ii)

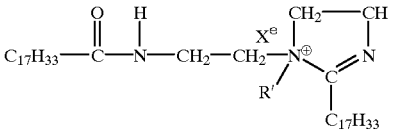

wherein X is an anion.

67. The bathroom tissue of claim 55 wherein about 0.1 to about 0.3 pounds of the nitrogenous adhesive is added for each ton of fiber in the furnish.

68. The bathroom tissue of claim 67 wherein the nitrogenous adhesive is a glyoxylated polyacrylamide or a polyaminoamide.

69. The bathroom tissue of claim 68 wherein the glyoxylated polyacrylamide moiety is in the form of a blend or in the form of a terpolymer comprising polyacrylamide of at least 40 weight percent and glyoxal at least 2 weight percent.

70. The tissue of claim 10 wherein the cationic nitrogenous softener has a melting range of about 0° C. to 40° C. wherein the softener comprises an imidazoline moiety formulated with organic compounds selected from the group consisting of aliphatic polyols, aliphatic diols, alkoxylated aliphatic polyols, alkoxylated aliphatic diols, and mixtures of these compounds.

71. The tissue of claim 70 wherein the softener is dispersible in water at a temperature of about 1° C. to 100° C.

72. The tissue of claim 70 wherein the softener is dispersible in water at a temperature of about 1° C. to 40° C.

73. The tissue of claim 70 wherein the diol is 2,2,4 trimethyl 1,3 pentane diol.

74. The tissue of claim 70 wherein alkoxylated diol is ethoxylated 2,2,4 trimethyl 1,3 pentane diol.

75. The tissue of claim 70 wherein the imidazoline moiety is of the following formula:

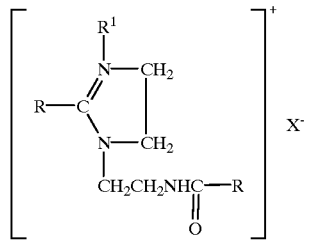

wherein X is an anion and R is selected from the group of saturated and unsaturated paraffinic moieties having a carbon chain length of $C_{12}$ to $C_{20}$ and $R^1$ is selected from the group of saturated paraffinic moieties having a carbon chain length of 1 to 3 carbon atoms.

76. The tissue of claim 75 wherein X is selected from the group of methyl sulfate and ethyl sulfate.

77. The tissue of claim 75 wherein X is chloride ion.

78. The tissue of claim 75 wherein R has a chain length of $C_{12}$ to $C_{18}$.

79. The tissue of claim 75 wherein R has a chain length of $C_{16}$ to $C_{18}$.

80. The bathroom tissue of claim 35 wherein the temporary wet strength agent is selected from the group of water-soluble uncharged organic compounds having aldehydic units and water-soluble organic polymers comprising aldehydic units and cationic units.

81. The single-ply bathroom tissue product of claim 33 having a basis weight of at least about 12.5 lbs. per 3000 square foot ream and exhibiting low sidedness, said tissue comprising from about 2 pounds per ton to about 25 pounds per ton of a water soluble temporary wet strength agent selected from the group of (1) uncharged aldehydes, uncharged aldehyde containing polymers, polyols and cyclic ureas, and mixtures thereof and charged cationic starches having aldehyde moieties, and (2) from about 1 pound per ton to about 10 pounds per ton of a cationic nitrogenous softener/debonder chosen from the group consisting of imidazolines, amido amine salts, linear amido amines, tetravalent ammonium salts and mixtures thereof wherein the ratio of the temporary wet strength agent to the nitrogenous cationic softener/debonder is selected to yield a single-ply tissue product having a specific total tensile strength of between 40 and 200 grams per 3 inches per pound per 3000 square foot ream, a cross direction specific wet tensile strength of between 2.75 and 20 grams per 3 inches per pound per 3000 square foot ream, the ratio of MD tensile to CD tensile of between 1.25 and 2.75, a specific geometric mean tensile stiffness of between 0.5 and 3.2 grams per inch per percent strain per pound per 3000 square foot ream, a friction deviation of less than 0.250, and a sidedness parameter of less than 0.30.

82. The bathroom tissue of claim 81 wherein the tissue product exhibits a specific total tensile strength of between 40 and 150 grams per 3 inches per pound per 3000 square foot ream, a cross direction specific wet tensile strength between 2.75 and 15 grams per 3 inches per pound per 3000 square foot ream, a specific geometric mean tensile stiffness of between 0.5 and 2.4 grams per inch per percent strain per pound per 3000 square foot ream, a friction deviation of less than 0.250 and a sidedness parameter of less than 0.30.

83. The bathroom tissue of claim 82 wherein the tissue product exhibits a specific tensile strength between 40 and 75 grams per 3 inches per 3000 square foot ream, a cross direction specific wet tensile strength of between 2.75 and 7.5 grams per 3 inches per pound per 3000 square foot ream, a specific geometric mean tensile stiffness of between 0.5 and 1.2 grams per inch per percent strain per pound per 3000 square foot ream, a friction deviation of less than 0.225; and a sidedness parameter of less than 0.275.

84. Roll of the single-ply bathroom tissue of claim 3 which has been embossed exhibiting puffiness and bulk having a serpentine configuration and a plurality of bosses formed therein comprising:

an array of stitch-shaped bosses forming a lattice of polygonal cells;

each said polygonal cell being centrally filled with a plurality of bosses forming one of a multiplicity of signature emboss patterns comprising at least a first signature emboss pattern and a second signature emboss pattern, said first signature emboss pattern being non-nesting with said second signature emboss pattern, said bosses being arrayed such that one of said first signature emboss patterns nests with another of said first signature emboss patterns at no more than three locations within said roll and one of said second signature emboss patterns nests with another of said second signature emboss patterns at no more than three locations within said roll and said one-ply tissue having a specific total tensile strength of between 40 and 200 grams per 3 inches per pound per 3000 square foot ream, a cross direction specific wet tensile strength of between 2.75 and 20.0 grams per 3 inches per pound per 3000 square foot ream, the ratio of MD tensile to CD tensile of between 1.25 and 2.75, a specific geometric mean tensile stiffness of between 0.5 and 3.2 grams per inch per percent strain per pound per 3000 square foot ream, a friction deviation of less than 0.250, and a sidedness parameter of less than 0.30.

85. Roll of the single-ply bathroom tissue of claim 84 wherein the tissue product exhibits a specific total tensile strength of between 40 and 150 grams per 3000 square foot ream, a cross direction specific wet tensile strength between 2.75 and 15 grams per 3 inches per 3000 square foot ream, a specific geometric mean tensile stiffness between 0.5 and 2.4 grams per inch per percent strain per pound per 3000 square foot ream, a friction deviation of less than 0.250 and a sidedness parameter of less than 0.30.

86. Roll of the single-ply bathroom tissue of claim 84 wherein the tissue product exhibits a specific tensile strength between 40 and 75 grams per 3 inches per 3000 square foot ream, a cross direction specific wet tensile strength of between 2.75 and 7.5 grams per 3 inches per pound per 3000 square foot ream, a specific geometric mean tensile stiffness of between 0.5 and 1.2 grams per inch per percent strain per pound per 3000 square foot ream, a friction deviation of less than 0.225; and a sidedness parameter of less than 0.275.

87. Roll according to claim 86 wherein said bosses are configured such that substantial nesting of said signature bosses on a roll occurs at a maximum of two locations.

88. Roll according to claim 86 wherein crenulated signature bosses are configured as two concentrically arranged hearts.

89. The absorbent paper product of claim 88 wherein alkoxylated diol is ethoxylated 2,2,4 trimethyl 1,3 pentane diol.

90. Absorbent paper product of claim 88 wherein diol is 2,2,4 trimethyl 1,3 pentane diol.

91. The absorbent bathroom tissue of claim 33 wherein after creping, the web is optionally calendered and wherein the web is embossed between mated emboss rolls, each of which contain both male and female elements.

* * * * *